United States Patent [19]

Sugai et al.

[11] 4,422,448

[45] Dec. 27, 1983

[54] MASSAGING APPARATUS

[75] Inventors: Haruo Sugai; Takafumi Hamabe; Yukio Yamamura; Shinpei Otuka; Hiroshi Moriwaki, all of Hikone, Japan

[73] Assignee: Matsushita Electric Works, Ltd., Osaka, Japan

[21] Appl. No.: 333,566

[22] Filed: Dec. 22, 1981

[30] Foreign Application Priority Data

Aug. 20, 1981 [JP] Japan ..... 56-130628

[51] Int. Cl.[3] ..... A61H 7/00

[52] U.S. Cl. ..... 128/44; 128/56; 128/60; 128/57; 297/217

[58] Field of Search ..... 128/44, 56, 57, 60, 128/70, 71, 72, 73, 74; 297/217

[56] References Cited

U.S. PATENT DOCUMENTS 3,483,862 12/1969 Takeuchi ..... 128/60
3,633,571 1/1972 Shinagawa et al. ..... 128/44
4,016,872 4/1977 Yamamura et al. ..... 128/44
4,167,182 9/1979 Yamamura et al. ..... 128/56

*Primary Examiner*—Lee S. Cohen
*Assistant Examiner*—George Yanulis
*Attorney, Agent, or Firm*—Birch, Stewart, Kolasch & Birch

[57] ABSTRACT

A massaging apparatus comprises a pair of massaging wheels obliquely and eccentrically attached to a main shaft, a shifting mechanism for shifting the massaging wheels and main shaft in the direction of the length of a chair back rest or a bed, and a spacing changing mechanism for changing the spacing between the massaging wheels. The apparatus is designed to detect the position of the pair of massaging wheels and the spacing therebetween. It further comprises position selecting switches associated with the neck, shoulders, back and waist of the human body. When any one of these position selecting switches is operated, the shifting mechanism and the spacing changing mechanism as well as the rotative direction of the main shaft are automatically controlled in accordance with the detected shifted position and spacing of the massaging wheels.

21 Claims, 34 Drawing Figures

MASSAGING APPARATUS

BACKGROUND OF THE INVENTION

1. Field of the Invention

This invention relates generally to massaging apparatuses and, more specifically, to a massaging apparatus which is installed in the back rest of a chair or in a bed and adapted to massage desired parts of the human body supported thereon.

This invention is an improvement upon the invention of United States Patent Application Ser. No. 333,635, filed on the same date, entitled "Massaging Apparatus", and commonly owened.

2. Description of the Prior Art

Massaging machines adapted to massage part of the human body supported on the back rest of a chair or on a bed by means of a pair of massaging wheels driven for rotation have already been known, as disclosed in U.S. Pat. Nos. 3,633,571 issued Jan. 11, 1972 and 4,167,182 issued Sept. 11, 1979. U.S. Pat. No. 3,633,571 discloses a massaging machine having a pair of massaging wheels attached to a main shaft in inclined relation thereto. In such massaging machine, the rotation of the main shaft and hence the massaging wheels by a motor provides the same massaging effect on the human body as that provided by a masseur. In this patent, the spacing between the pair of massaging wheel is variable. Thus, by changing the spacing, the massaging wheels can be positioned on widthwise spaced desired parts of the human body. Likewise, U.S. Pat. No. 4,167,182 discloses a massaging apparatus having a pair of massaging wheels attached to a main shaft. In this U.S. Patent, the pair of massaging wheels are shiftable, e.g., in the direction of the length of a chair, i.e., vertically so that they may be brought to an optimum position on the human body. Thus, massaging apparatuses adapted to adjust the spacing or vertical position of a pair of massaging wheels have already been proposed.

Further, a massaging apparatus adapted to adjust both the vertical position and spacing of a pair of massaging wheels has already been put into practical use. In such conventional massaging apparatuses, however, their operations are very complex or troublesome. More specifically, the conventional massaging apparatus is provided with separate operating means, i.e., a means for vertically moving the massaging wheels and a means for adjusting the spacing of the massaging wheels. For example, when it is desired to massage the shoulders, the operating means for vertical movement is first manipulated to bring the massaging wheels to the level of the shoulders and then the other operating means is manipulated to suitably increase the massaging wheel spacing. Thus, with the conventional massaging apparatus, when it is desired to bring the massaging wheels to a desired position on the human body, it has been necessary to manipulate the two operating means so as to position the massaging wheels. Further, since the massaging wheels are eccentrically attached to the main shaft, the massaging effect attainable differs with the direction of rotation of the massaging wheels. For example, the satisfactory direction of rotation for massaging the shoulders is opposite to that for the waist. In the conventional massaging apparatus, therefore, to obtain the best massaging effect, it has been necessary to determine and select the required direction of rotation of the massaging wheels. Thus, there has been a drawback that because of the complex operation required, it is impossible for general users, particularly elderly persons, to make effective use of the overall function of the massaging machine or, even if such is possible, it is very difficult for them to understand how to operate the massaging machine.

SUMMARY OF THE INVENTION

A massaging apparatus according to this invention comprises a pair of massaging wheels attached to a main shaft, a position changing mechanism for shifting the massaging wheels in a direction which crosses the axis of the main shaft to change the position of the massaging wheels, and a spacing changing mechanism for axially moving the massaging wheels toward and away from each other to change the spacing therebetween. When a massage mode including the position and spacing of the massaging wheels as its elements is designated, the position changing mechanism and the spacing changing mechanism are automatically controlled in response thereto so as to conform the pair of massaging wheels to the selected massage mode.

According to this invention, unlike the prior art, there is no need for troublesome operations for controlling the position and spacing of the massaging wheels to adapt them to a desired massage mode. Therefore, the overall function of the massaging apparatus can be utilized in a simple operation.

In a preferred embodiment of the invention, the massaging wheels are obliquely and preferably eccentrically attached to the main shaft to exert different massaging effects with different directions of rotation. When a certain massage mode is selected, the direction of rotation of the massaging wheels is controlled to ensure that an optimum massaging effect is obtained for the selected massage mode. That is, in response to the selection of a massage mode, the massaging wheels are brought to a position conforming to the selected massage mode with their spacing adjusted to conform thereto and are then rotated in a direction suited for the selected massage mode. Therefore, according to this preferred embodiment, by simply selecting a massage mode, the massaging wheels can be rotated in a direction suited for the selected massage mode without requiring any troublesome operation.

Another preferred embodiment of the invention includes manual operating means for adjusting the position and spacing of the massaging wheels. As a result, the position and spacing of the massaging wheels can be relatively freely adjusted.

Accordingly, a main object of the invention is to provide a massaging apparatus which is easy to operate.

An aspect of the invention resides in a massaging apparatus wherein the designation of a massage mode is enough to ensure that a pair of massaging wheels assume a position and a spacing suited for the designated massage mode.

Another aspect of the invention resides in a massaging apparatus wherein the massaging wheels are driven for rotation in a direction suited for a selected massage mode.

A further aspect of the invention resides in a massaging apparatus designed so that the position and/or the spacing of a pair of massaging wheels can be manually adjusted.

These objects and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
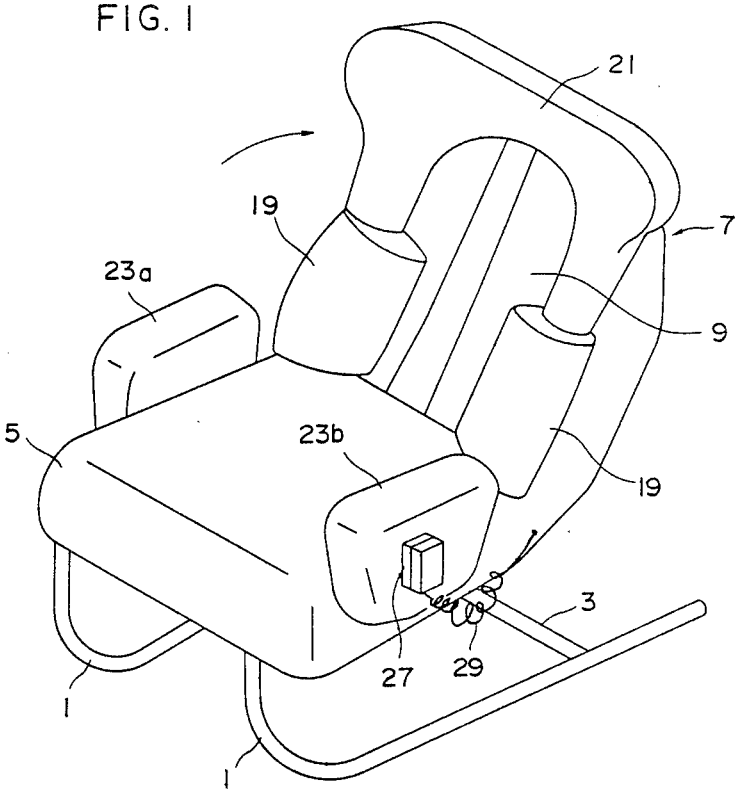
FIGS. 1 and 2 are respective views of an embodiment of the invention, FIG. 1 being a front perspective view and FIG. 2 being a rear perspective view with a rear cover removed.
Figure 2:
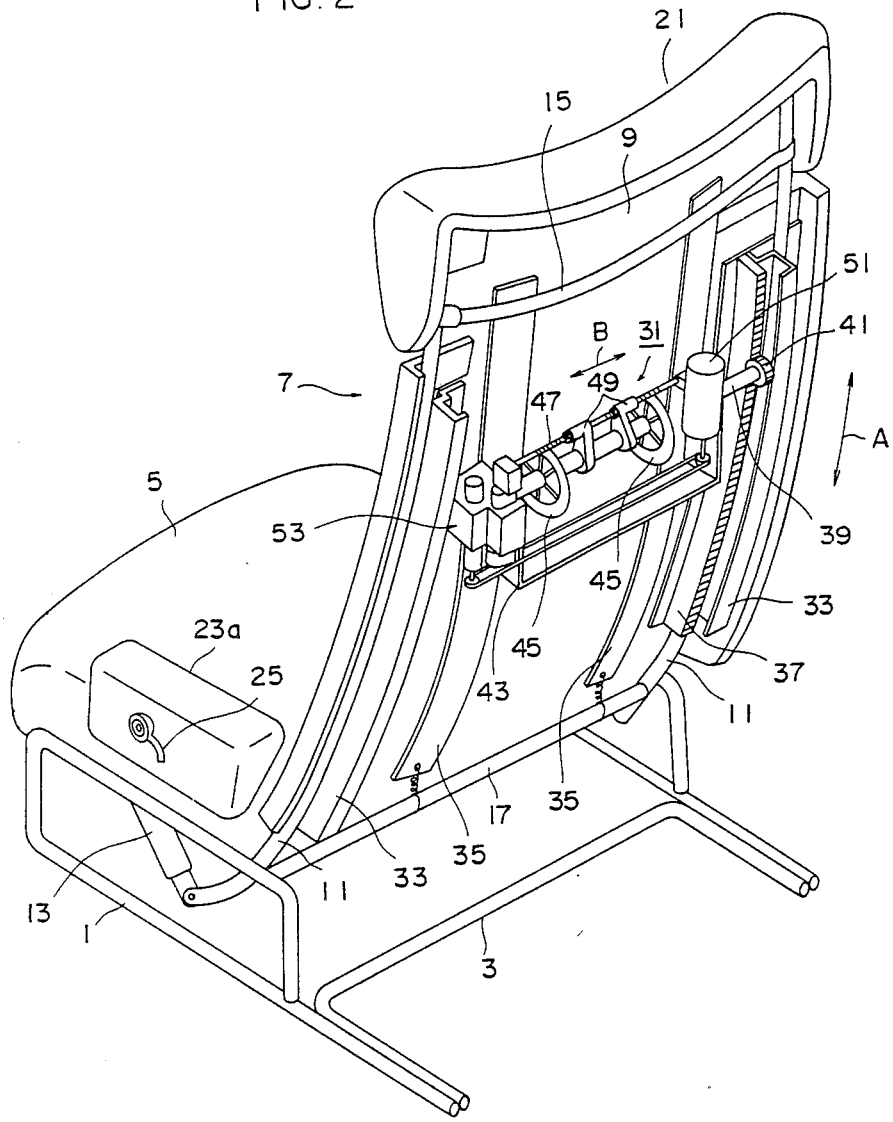

FIGS. 1 and 2 are perspective views showing the entirety of an embodiment of this invention, FIG. 1 being a front perspective view and FIG. 2 being a rear perspective view with a rear cover removed. The massaging machine will be built in the back rest of a chair or in a bed so that the waist, back, shoulders or the neck of the human body placed thereon may be massaged. The following embodiment refers to a case where it is built in the back rest of a chair.

A chair in which the massaging machine is to be built comprises a frame assembly which is made of a metallic pipe and includes a pair of lower frames 1 and a frame 3 interconnecting the latter. The frame assembly thus constructed has a seat 5 and a back rest 7 attached thereto, said back rest 7 including a cover sheet 9. The cover sheet 9 is supported by side frames 11, each being connected at one end thereof to the associated lower frame 1 by a gas spring 13. The upper and lower portions of the side frames 11 are respectively interconnected by connector frames 15 and 17. The lateral edges of the cover sheet 9 constituting the back rest 7 are each provided with a cushion 19, and its upper end is constructed as a head rest 21. Opposite sides of the seat 5 are provided with arm rests 23*a* and 23*b*. The arm rest 23*a* is provided with a lever 25 connected to the gas spring 13 to act on the latter in such a manner as to expand or contract the gas spring 13 when the lever 25 is operated. Thus, by operating the lever 25, it is possible to tilt the back rest 7 in the directions of arrows (FIG. 1). The arm rest 23*b* has an operating unit 27, to be later described in more detail, removably attached thereto, said operating unit 27 being connected by a connection cord 29 to a control circuit including a microprocessor to be later described. Since the operating unit 27 is removable from the arm rest 23*b*, the user may operate it at any desired position. The operation of the operating unit 27 and movements concomitant therewith will be later described in detail, but for the present suffice it to say that operating the operating unit 27 controls the control circuit and hence a massaging mechanism 31 installed on the back of the cover sheet 9 of the back rest 7.

In addition, the cushions 19 installed on the back rest 7 are shaped to snugly receive therebetween the part of the human body extending from the shoulders to the waist. Thus, the function not only as cushions but also as clamps for clamping the human body from opposite sides.

Rails 33 are installed along the side frames 11. Support belts 35 extend between the connector frames 15 and 17, the lower ends of said support belts 35 being connected to the connector frame 17 by coil springs and the upper ends being fitted between the connector frame 15 and the cover sheet 9. The rails 33 are substantially U-shaped in cross-section and respectively attached to the associated side frames such that their openings are opposed to each other. Racks 37 are provided along the rails 33 on their open side to extend lengthwise of the rails. The racks 37 mesh with pinions 41 provided on the opposite ends of a main shaft 39. The main shaft 39 cooperates with a support frame 43 to constitute the massaging mechanism 31. Therefore, the massaging mechanism 31 is capable of moving vertically, i.e., in the directions of arrows A (FIG. 2) as the pinions 41 rotate while meshing with the racks 37.

As will be later described in detail, the massaging mechanism 31 comprises a U-shaped support frame 43 and the main shaft 39 supported by the latter. The main shaft 39 has a pair of massaging wheels 45 attached thereto preferably in inclined relation thereto. The massaging wheels 45 are connected to a feed shaft 47 by connector arms 49. The support frame 43 has a drive motor 51 attached to one lateral plate thereof and a gear box 53 attached to the other lateral plate thereof. The driving force of the drive motor 51 is transmitted to the main shaft 39 and feed shaft 47 through the gear box 53, so that the main shaft 39 and feed shaft 47 are rotated. As the main shaft 39 is rotated, a pair of massaging wheels 45 attached thereto are rotated, whereby massaging is effected. As the feed shaft 47 is rotated, the connector arms 49 and hence the massaging wheels 45 are displaced in the directions of arrows B, whereby the spacing of the massaging wheels 45 is adjusted. These will be later described in more detail.

Figure 3:
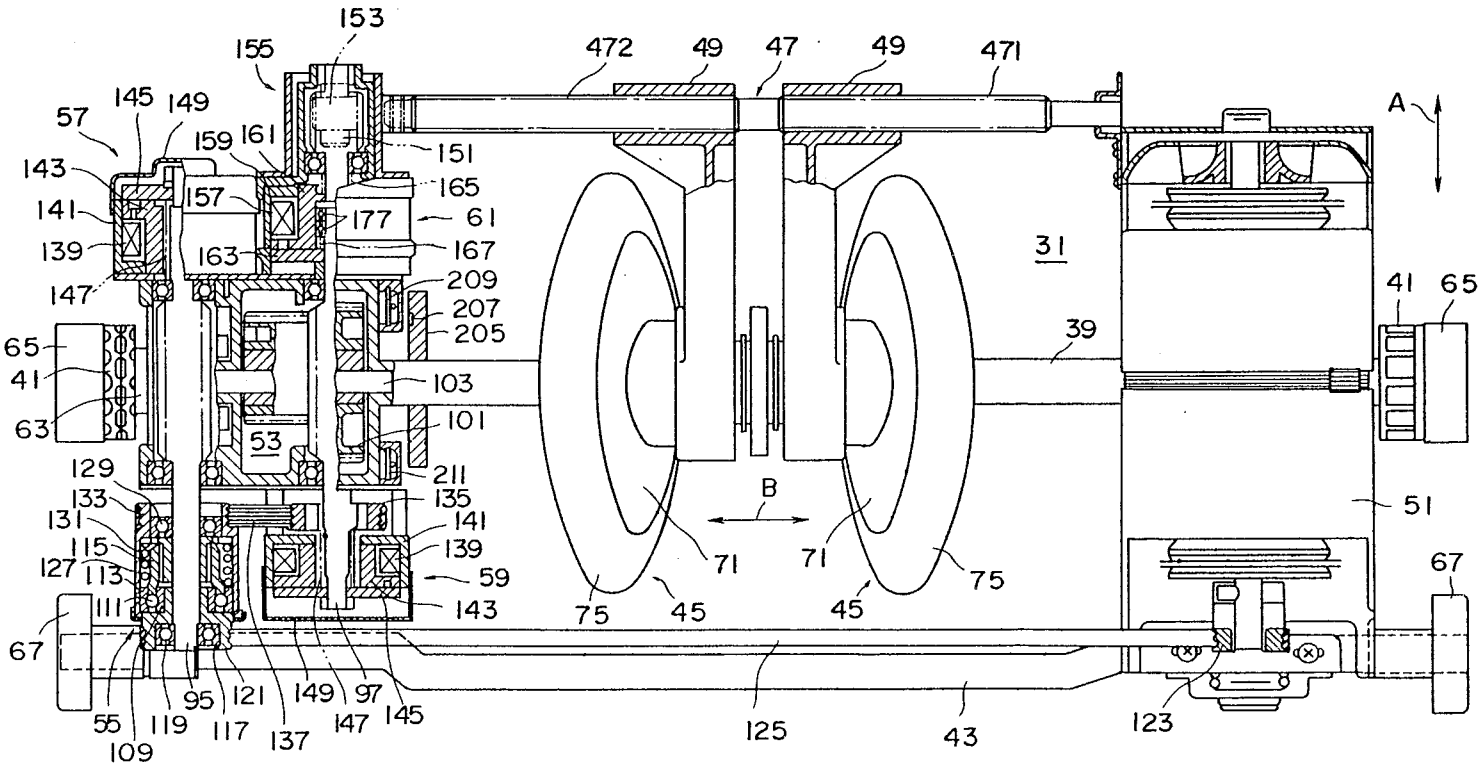
FIGS. 3 and 4 are partly sectional views, mainly showing a massaging mechanism in detail, FIG. 3 being a front view and FIG. 4 being a plan view.
Figure 4:
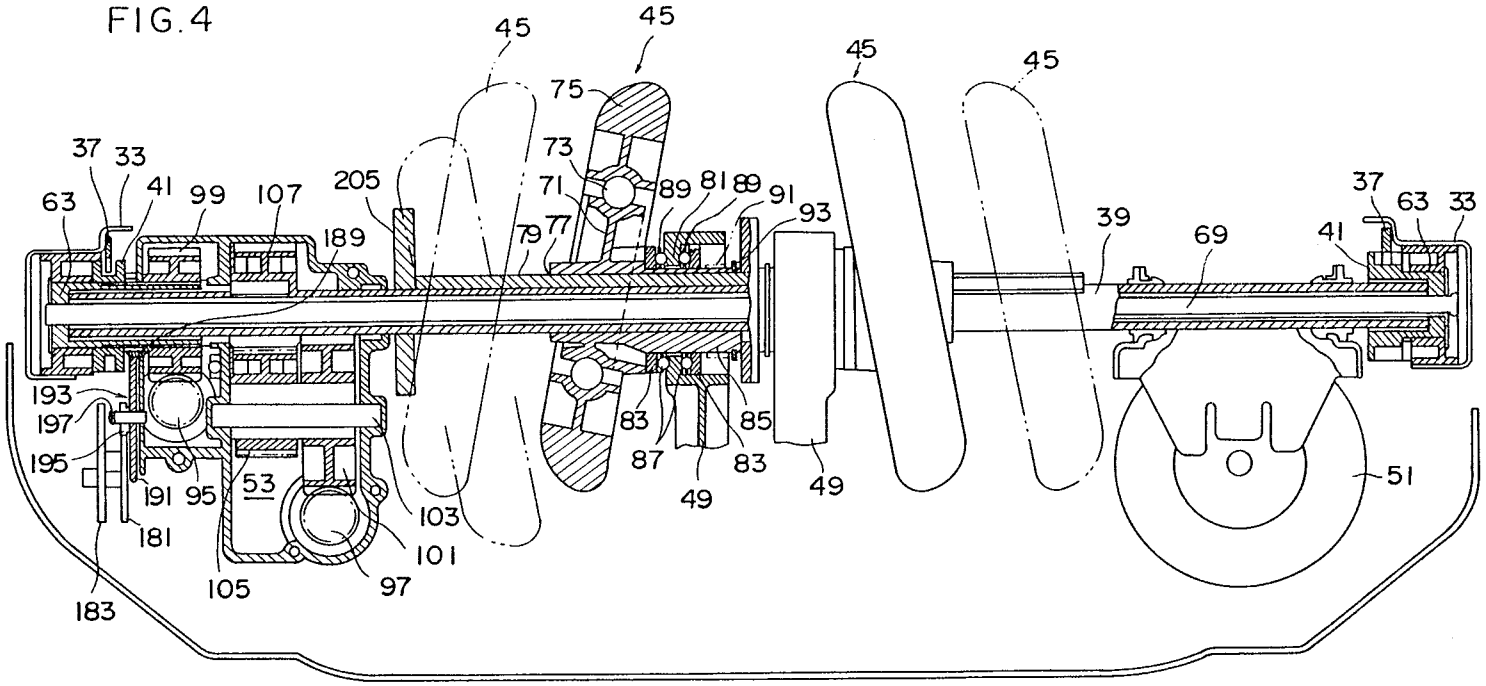

FIGS. 3 and 4 are partly sectional views, mainly showing the massaging mechanism 31, FIG. 3 being a front view and FIG. 4 being a plan view. The massaging mechanism 31 comprises the main shaft 39 supported by the support frame 43, the reversible drive motor 51 attached to one lateral plate of the support frame 43, and the gear box 53 attached to the other lateral plate of the support frame 43. Also installed on the other lateral plate of the support frame 43 are a planetary device 55, electromagnetic brakes 57 and 59 and an electromagnetic clutch 61, which are associated with the gear box 53. These devices 55, 57, 59 and 61 cooperate with the gear box 53 to transmit switchingly the driving force of the drive motor 51 to the main shaft 39 and the feed shaft 47 or a shifting shaft 69.

Cylindrical bodies 63 are mounted for free rotation on the main shaft 39 at the opposite ends thereof and rollers 65 are freely rotatably attached to said cylindrical bodies 63. Rollers 67 are freely rotatably attached to the lower side of the support frame 43 at the opposite ends thereof. These rollers 65 and 67 are received in the rails 33 (FIG. 2) so that they can roll therein. As can be best seen in FIG. 4, the main shaft 39 is a hollow shaft and a shifting shaft 69 is coaxially inserted therein. The shifting shaft 69 has said cylindrical bodies 63 spline-coupled thereto at the opposite ends. Each cylindrical body 63 is formed with a pinion 41 meshing with the associated rack 37 (FIG. 2) described above. When the shifting shaft 69 is rotated, therefore, the massaging mechanism 31 is moved vertically, i.e., in the directions of arrows A along the back of the back rest 7 (FIG. 2).

The massaging wheels 45 attached to the main shaft 39 each comprise an eccentric inner wheel 71 and an outer wheel 75 freely rotatably mounted on said eccentric inner wheel 71 through balls 73. The inner peripheral surface of the eccentric inner wheel 71 is formed with a widthwise extending groove 77, which is spline-coupled to a projection 79 formed axially on the outer periphery of the main shaft 39. Thus, when the main shaft 39 is driven for rotation, the eccentric inner wheels 71 are rotated. In this manner, the groove 77 cooperates with the projection 79 to make the massaging wheels 45 slidable axially of the main shaft 39 and rotatable with the main shaft 39. In this embodiment, the massaging wheels 45, as can be best seen in FIG. 4, are eccentric by the same amount and in the same direction and inclined by the same degree and in mutually opposite directions with respect to the main shaft 39. Therefore, when the massaging wheels 45 are rotated, the protruding amount of the massaging wheels 45 to be later described from the main shaft 39 toward the cover sheet 9 (FIG. 1) periodically changes and so does the spacing between the massaging wheels 45. Thus, the back of the human body leaning against the back rest 7 (FIG. 1) are massaged. There are two types of massage, "UPWARD MASSAGE" and "DOWNWARD MASSAGE", according to the direction of rotation of the massaging wheels 45. Upward massage refers to a case where the portions of the massaging wheels 45 that have a greater protruding amount move upwardly while massaging the human body. Downward massage refers to the reverse case where the portions of the massaging wheels 45 that have a greater protruding amount move downwardly while massaging the human body. Such upward massage and downward massage have different massaging effects, which will be later described.

The mechanism for changing the spacing between the pair of massaging wheels 45 will now be described mainly with reference to FIGS. 3 and 4. This spacing changing mechanism includes the feed shaft 47, which is parallel with the main shaft 39. The feed shaft 47 is constructed such that substantially one half of its length is a right-hand threaded portion 471 and the other half is a left-hand threaded portion 472. The right-hand and left-hand threaded portions 471 and 472 have one of the respective ends of the corresponding connector arms 49 threadedly engaged therewith. The other ends of the connector arms 49 are connected to the eccentric inner wheels 71 of the corresponding massaging wheels 45. The eccentric inner wheels 71 are axially movable on the main shaft 39, as described above. Therefore, if the feed shaft 47 is rotated in a certain direction, the spacing between the connector arms 49 and hence the spacing between the massaging wheel 45 are increased, while if it is rotated in the opposite direction, said spacings are decreased.

In this embodiment, the eccentric inner wheels 71 of the massaging wheels 45 are freely rotatable relative to the connector arms 49 through thrust bearings. This is because whenever the feed shaft 47 is rotated, the main shaft 39 and hence the massaging wheels 45 are rotated, as will be later described in more detail, so that it is necessary to prevent the human body from being subjected to undesirable pressures when the spacing between the massaging wheels 45 is to be changed. The opposite surfaces of an inner flange 81 at one end of each connector arm 49 serve as race surfaces, and race plates 83 cooperating with said race surfaces are provided on the outer periphery of a sleeve 85 formed on the eccentric inner wheel 71, as shown in FIG. 4. Balls 87 held by retainers 89 are disposed between the race plates 83 and the race surfaces of the inner flange 81. In this manner, thrust bearings are constituted. These thrust bearings make the eccentric inner wheels 71 freely rotatable relative to the connector arms 49.

Further, in this embodiment, the connector arms 49 are disposed between the massaging wheels 45, so that the movements of the connector arms 49 for decreasing the spacing between the massaging wheels 45 are transmitted to the massaging wheels 45 through respective thrust springs 91. More specifically, such trust spring 91 is disposed on the outer periphery of the sleeve 85 and held between the associated race plate 83 and a stop ring 93, resiliently urging the thrust bearing toward the massaging wheel 45. Therefore, in cases where the feed shaft 47 is rotated to decrease the spacing between the massaging wheels 45 or where the massaging wheels 45 are rotated with said spacing decreased, it is possible for the massaging wheels 45 to move away from each other to increase their spacing against the forces of the thrust springs 91 in such regions as the neck where the massaging effect is relatively high. Thus, safety is ensured in that there is no danger of a force greater than is necessary acting on such parts of the human body as the neck. Thus, the thrust springs 91 provide a softer massaging effect and prevent the thrust bearings from rattling.

As described above, in the massaging machine of this embodiment, the shafts to be driven for rotation are the main shaft 39, shifting shaft 69 and feed shaft 47. These shafts are all driven by the reversible drive motor 51. Meanwhile, the main shaft 39 and the shifting shaft 69 are selectively driven. The feed shaft 47 is driven only when the main shaft 39 is connected to the motor 51.

The mechanism for transmitting the driving power from the drive motor to the respective shafts will now be described. The driving mechanism, as shown in FIG. 3, comprises the gear box 53, planetary device 55, electromagnetic brakes 57 and 59 and electromagnetic clutch 61. The output from the planetary device 55 is selectively transmitted to either one of worm shafts 95 and 97. As can be best seen in FIG. 4, the worm on the worm shaft 95 meshes with a worm wheel 99 spline-coupled to the outer periphery of the cylindrical body 63, while the worm on the worm shaft 97 meshes with a worm wheel 101 supported by a shaft 103. The rotation of the worm wheel 99 is transmitted to the shifting shaft 69, while the rotation of the worm wheel 101, as seen in FIG. 4, is transmitted to the main shaft 39 through an elliptical gear 105 supported by the shaft 103 and an elliptical gear 107 fixed on the main shaft 39.

In this embodiment, the planetary device 55 uses radial ball bearings for the purpose of reducing size and noise. In this embodiment, the inner race 109 corresponds to a sun gear, the balls 111 correspond to a planetary gear, the outer race 113 corresponds to an internal gear, and the retainer 115 corresponds to a planetary carrier. The inner race 109 is fixed on the outer periphery of the collar 117 freely rotatably mounted on the lower end of the worm shaft 95 through a bearing 119. The collar 117 has a pulley 121 fixed thereto, and a belt 125 is passed around said pulley 121 and a pulley 123 fixed on the output shaft of the motor 51. In this manner, the planetary device 55 is driven by the motor 51. The retainer 115 is fixed on the worm shaft 95, and the outer race 113 is fixed on a cover 127 supported by a bearing 129. The planetary device 55 includes a thrust spring 131 urging the outer race 113 in the thrust direction to produce a thrust preload between the outer race 113, the balls 111 and the inner race 109. A pulley 133 is formed on the cover 127 surrounding the retainer 115. The pulley 133 is connected to a pulley 135 fixed on the lower portion of the worm shaft 97, through a belt 137.

With the worm shaft 95 braked, if the collar 117 and inner race 109 are rotated by the motor 51, the rotation of the balls 111 around the axis of the inner race 109 is prevented by the retainer 115. Therefore, the balls 111 rotate only around their respective axes, whereby the outer race 113 is rotated. The worm shaft 97 is driven for rotation through the pulley 133, belt 137 and pulley 135. Conversely, if the worm shaft 97 is held braked, since the rotation of the outer race 113 is prevented by the belt 137, the balls 111 rotate around their respective axes and also around the axis of the inner race 109, whereby the worm shaft 95 is rotated through the retainer 115.

In this manner, the worm shaft which is different from the one desired to be driven by the motor 51 is braked and the driving force from the motor 51 is switchwise transmitted. Brakes on the worm shafts 95 and 97 can be applied by the corresponding electromagnetic brakes 57 and 59, respectively. These two electromagnetic brakes 57 and 59 only differ in the position where they are installed, the construction thereof being substantially the same. More specifically, the electromagnetic brakes 57 and 59 each comprise a coil 139, a yoke 141, a core 143, a brake shoe 145, a return spring 147, and a cover 149. The brake shoes 145 are respectively spline-coupled to the associated worm shafts 95 and 97, so that they are axially slidable therealong. When the coil 139 is energized, the resulting electromagnetic force attracts the brake shoe 145 against the force of the return spring 147 until the brake shoe 145 contacts the core 143. In this manner, the electromagnetic brakes 57 and 59 brake the associated worm shafts 95 and 97, respectively. Therefore, if the coil 139 of the electromagnetic brake 57 is energized, the worm shaft 97 is rotated by the motor 51, while if the coil 139 of the electromagnetic brake 59 is energized, the worm shaft 95 is driven for rotation.

Figure 5:
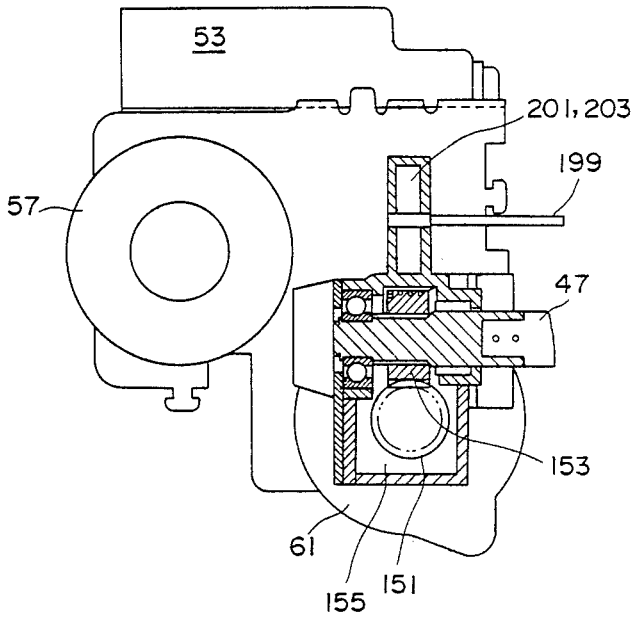
FIG. 5 is a partly sectional view showing a gear box in detail.

The feed shaft 47 for changing the spacing between the massaging wheels 45 receives output from the worm shaft 97 through the electromagnetic clutch 61. More specifically, a worm shaft 151 is provided coaxially above the worm shaft 97. As can be best seen in FIG. 5, the worm on the worm shaft 151 meshes with a worm wheel 153 formed on one end of the feed shaft 47. The worm shaft 151 and worm wheel 153 are received in a gear box 155, which is attached to the upper surface of the electromagnetic clutch 61. The electromagnetic clutch 61 comprises a coil 157, a yoke 159, a core 161, a clutch shoe 163, a hold-down spring 165, and a return spring 167. The clutch shoe 163 is spline-coupled to the upper end of the worm shaft 97. The core 161 is spline-coupled to the worm shaft 151, and bearings 177 are installed between the core 161 and the worm shaft 97. The coil 157, when energized, attracts the clutch shoe 163 against the force of the return spring 169 upwardly until the clutch shoe 163 comes in contact with the core 161. In this state, the rotation of the worm shaft 97 is transmitted to the worm shaft 151 through the clutch shoe 163 and core 161. In accordance with the rotation of the worm shaft 151, the worm wheel 153 and hence the feed shaft 47 are driven for rotation.

Figure 6A:
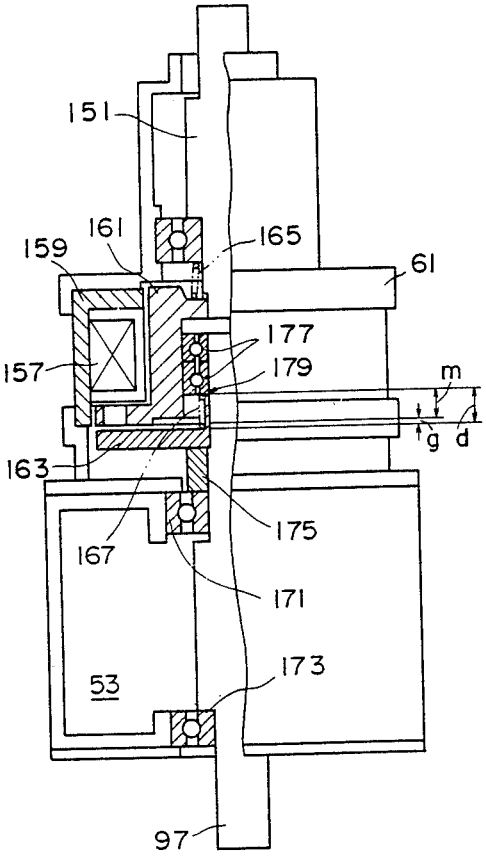
FIGS. 6A and 6B are partly sectional views showing an electromagnetic clutch and related arrangement.
Figure 6B:
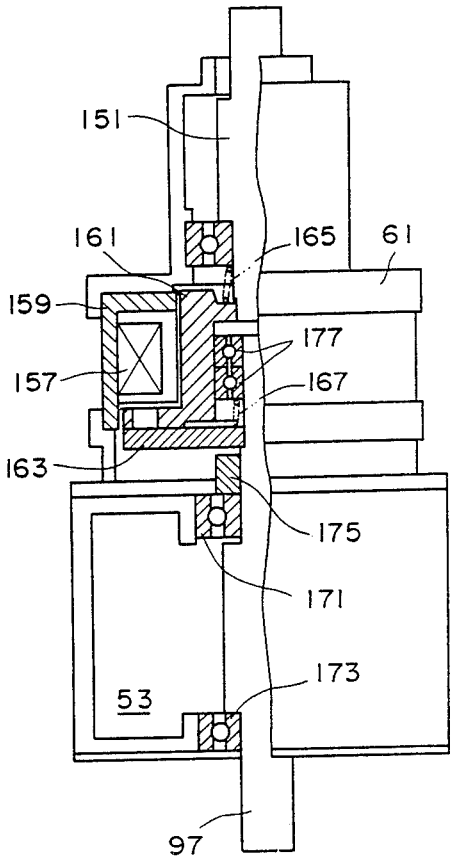

The electromagnetic clutch 61 is assembled in the following manner to make unnecessary the troublesome adjustment of the gap between the core 161 and the clutch shoe 163 after assembly. The worm shaft 97 is positioned in the thrust direction by the gear box 53. As shown in FIGS. 6A and 6B, bearings 171 and 173 and thrust bushing 175 are force-fitted on the worm shaft 97 so that the dimension d between the clutch shoe 163 and a step 179 provided on the worm shaft 97 for positioning bearings 177 is equal to a predetermined value. The bearings 177 are force fitted in the core 161 so that the dimension m between the lower end of said bearings 177 and the lower end of the core 161 is equal to a predetermined value. The dimensions d and m are determined such that $d=m+g$, where g is the dimension of the gap between the core 161 and the clutch shoe 163. With this arrangement, the electromagnetic clutch 61 can be assembled by simply controlling said dimensions d and m that they are equal to predetermined values, without requiring adjustment of the gap dimension g. In addition, the core 161 is slidable relative to the worm shaft 151 and is resiliently downwardly urged by a hold-down spring 165, whereby the bearing 177 force-fitted in the core 161 is brought into abutment against the step 179 on the worm shaft 97. FIG. 6A shows the electromagnetic clutch 61 as deenergized, and FIG. 6B shows it as energized. It will be understood from FIGS. 6A and 6B that the transmission of power between the worm shafts 97 and 151 is controlled by the electromagnetic clutch 61.

In addition, the main shaft 39, shifting shaft 69 and feed shaft 47 each are adapted to be driven by a worm and worm wheel combination. This is for the purpose of preventing the input from the driven side from acting on the driving side. Thus, massaging mechanism 31 of compact and well-balanced construction can be obtained by the arrangement shown in FIG. 3 comprising two parallel worm shafts 95 and 97, one worm shaft 95 being provided at its lower end with a power switching mechanism, i.e., planetary device 55 and at the other end with an electromagnetic brake 57, the other worm shaft 97 being provided at one end thereof with an electromagnetic brake 59 and at the other end with an electromagnetic clutch 61.

The massaging machine in this embodiment has the function of determining the spacing between the massaging wheels 45 and the vertical position, i.e. an upward/downward directional position thereof and also determining the direction of rotation of the massaging wheels 45. To this end, means are provided for detecting various positions.

Referring to FIGS. 7, 8A, 8B and 9, a mechanism for detecting the upward/downward directional position of the massaging mechanism 31 and hence the pair of massaging wheels 45 along the rails 33 (FIG. 2) will now be described. This upward/downward directional position is detected by first and second disks 181 and 183 and two photoelectric switches 185 and 187. The first and second disks 181 and 183 are adapted to be rotated as a unit with the rotation of the shifting shaft 69. However, the rotation of the shifting shaft 69 is transmitted to these disk 181 and 183 at a predetermined reduction ratio. This reduction ratio is such that when the massaging mechanism 31 is vertically moved along the rails 33, these disks 181 and 183 are rotated not more than one revolution. A reduction mechanism for providing such reduction ratio comprises a gear 189 formed on a lateral surface of a worm wheel 155, a gear 191 meshing with said gear 189, and a gear 195 connected to said gear 191 through a dog clutch 193, said first disk 181 meshing with said gear 195. Thus, when the shifting shaft 69 is moved within the shifting range along the rails 33, the first and second disks 181 and 183 are rotated not more than one revolution. In addition, the purpose of installing the dog clutch 193 between the gears 191 and 195 is to provide convenience in assembling the reduction mechanism. More specifically, with the massaging mechanism 31 placed on the uppermost region of the back rest 7 (FIG. 1), the dog clutch 193 is disengaged and the disks 181 and 183 are rotated so that an uppermost end detection signal to be later described may be obtained, said disks 181 and 183 being then connected to said gear 195 by the dog clutch 193. At this time, a spring 197 provides a resilient force for engaging the clutch 193.

Figure 8A:
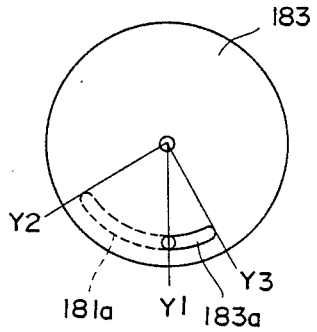
Figure 8B:
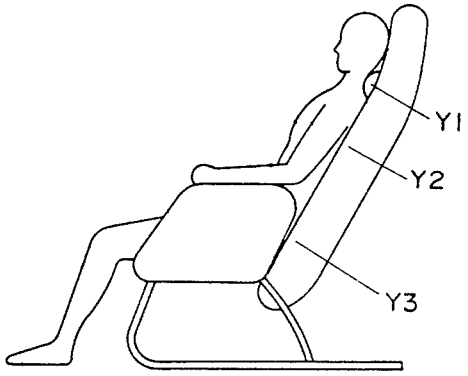
Figure 9:
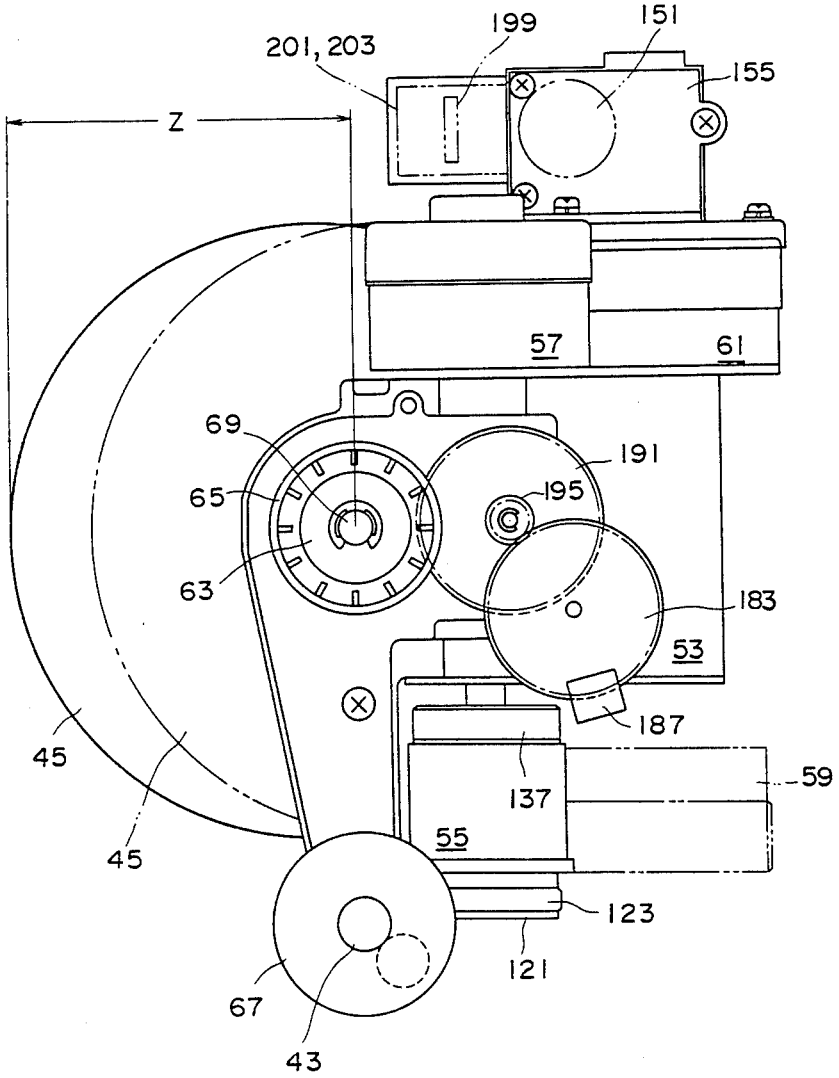

In this embodiment, vertical positions, i.e. upward/-downward directional positions to be detected are Y1, Y2, Y3 (FIG. 8B). The position Y1 is the upper end position of the massaging wheels 45 corresponding to the shoulders and neck of the human body, the position Y3 is the lower end position thereof corresponding to the waist of the human body, and the position Y2 is the intermediate position corresponding to the back of the human body. The first disk 181 is formed with an arcuate opening 181*a* subtending a central angle corresponding to the distance between the positions Y1 and Y2, and the second disk 183 is formed with an arcuate opening 183*a* subtending a central angle approximately equal to 360 degrees minus the angle of rotation of the first disk 181 corresponding to the distance from the position Y1 to the position Y3. One end of the arcuate opening 183*a* coincides with one end of the arcuate opening 181*a*. The photoelectric switches 185 and 187 each comprise a light emitting device and a light receiving device opposed to each other on both sides of each of the first and second disks 181 and 183 so that said photoelectric switches 185 and 187 may detect the arcuate openings 181*a* and 183*a*, respectively. It is to be understood that the photoelectric switches 185 or 187 will be turned on when the light receiving device receives the light from the associated light emitting device through the arcuate opening 181*a* or 183*a*. When the two switches 185 and 187 are both turned on, this means that the massaging mechanism 31, i.e., the massaging wheels 45 are at the upper end position Y1. If the photoelectric switch 185 alone is turned on, this means that the massaging wheels 45 are located between the upper end position Y1 and the intermediate position Y2. If the photoelectric switch 185 is turned from on to off or from off to on, this means that the massaging wheels 45 are at the intermediate position Y2. If the two photoelectric switches 185 and 187 are both turned off, this means that the massaging wheels 45 are located between the intermediate position Y2 and the lower end position Y3. If the photoelectric switch 187 alone is turned on, this means that the massaging wheels 45 are at the lower end position Y3. In this manner, the vertical position of the massaging mechanism 31 and hence the massaging wheels 45 can detected according to whether the signals from the photoelectric switches 185 and 187.

The mechanism for detecting the spacing between the massaging wheels 45 will now be described with mainly reference to FIGS. 10, 11A and 11B. The spacing detecting mechanism comprises a detecting plate 199 attached to one connector arm 49, and two photoelectric switches 201 and 203. The detecting plate 199 is fixed at one end thereof to said one connector arm 49, and the photoelectric switches 201 and 203, attached, e.g., to a lateral surface of the gear box 155 (FIG. 3), is positioned at the other end of said detecting plate 199. The photoelectric switches 201 and 203 each comprise, in combination, a light emitting device and a light receiving device. The other end of the detecting plate 199 is formed with elongated openings 199*a* and 199*b* arranged so that they can be detected by the photoelectric switches 201 and 203. Thus, the photoelectric switch 201 detects the elongated opening 199*a* and the photoelectric switch 203 detects the elongated opening 199*b*. The spacings of the pair of massaging wheels 45 to be detected by the combination of the elongated openings 199*a*, 199*b* and photoelectric switches 201, 203 are three in number, i.e., X1, X2 and X3. The spacing X1 is the minimum spacing of the massaging wheels 45 corresponding to the neck and spinal muscle of the human body, the spacing X2 is the intermediate spacing of the massaging wheels 45 corresponding to the interscapular position, and the spacing X3 is the maximum spacing of the massaging wheels 45 corresponding to the shoulders of the human body. The positional relation of the elongated opening 199*a* and 199*b* formed in the detecting plate 199 and is shown in FIG. 11A. Further, the photoelectric switches 201 ad 203 will be turned on when their light receiving devices receive the light from the associated light emitting devices through the elongated openings 199*a* and 199*b*, respectively. Upon turning on of the photoelectric switch 203, when the photoelectric switch 201 is turned off at one side of the elongated opening 199*a*, this means that the spacing of the massaging wheels 45 is the minimum spacing X1. When the two photoelectric switches 201 and 203 are both turned on, this means that the spacing of the massaging wheels 45 is between the minimum spacing X1 and the intermediate spacing X2. Upon turning on of the photoelectric switch 201, when the photoelectric switch 203 is turned from on to off or from off to on, this means that the spacing of the massaaging wheels 45 is the intermediate spacing X2. If the photoelectric switch 201 alone is turned on, this means that the spacing of the massaging wheels 45 is between the intermediate spacing X2 and the maximum spacing X3. When the photoelectric switches 201 and 203 are both turned off, this means that the spacing of the massaging wheels 45 is the maximum spacing X3. In this manner, the massaging wheels 45 can be moved within the range shown in FIGS. 13 and 14.

Finally, the mechanism for detecting the protruding amount Z (FIG. 9) of the massaging wheels 45 from the main shaft 39 will be described. This protruding amount detecting mechanism, as an example, comprises a disk 205, a magnet 207, and reed switches 209 and 211. The disk 205 is fixed on the main shaft 39 adjacent the gear box 53, and the magnet 207 is embedded in the surface of the disk 205 facing to the gear box 53. Disposed on the lateral surface of the gear box 53 facing to the disk 205 are the reed switches 209 and 211 adapted to be turned on when actuated by the magnet 207. Thus, with the rotation of the main shaft 39, the disk 205 and hence the magnet 207 are rotated, whereby the protruding amount Z of the massaging wheels 45 can be detected. More specifically, when the reed switch 209 is turned on, the protruding amount Z of the massaging wheels 45 is at a maximum, and when the reed switch 211 is turned on, the protruding amount Z is at a minimum.

Meanwhile, instead of non-contact type switches such as the photoelectric switches 185, 187, 201, 203 use may be made of contact type switches such as limit switches.

Figure 12:
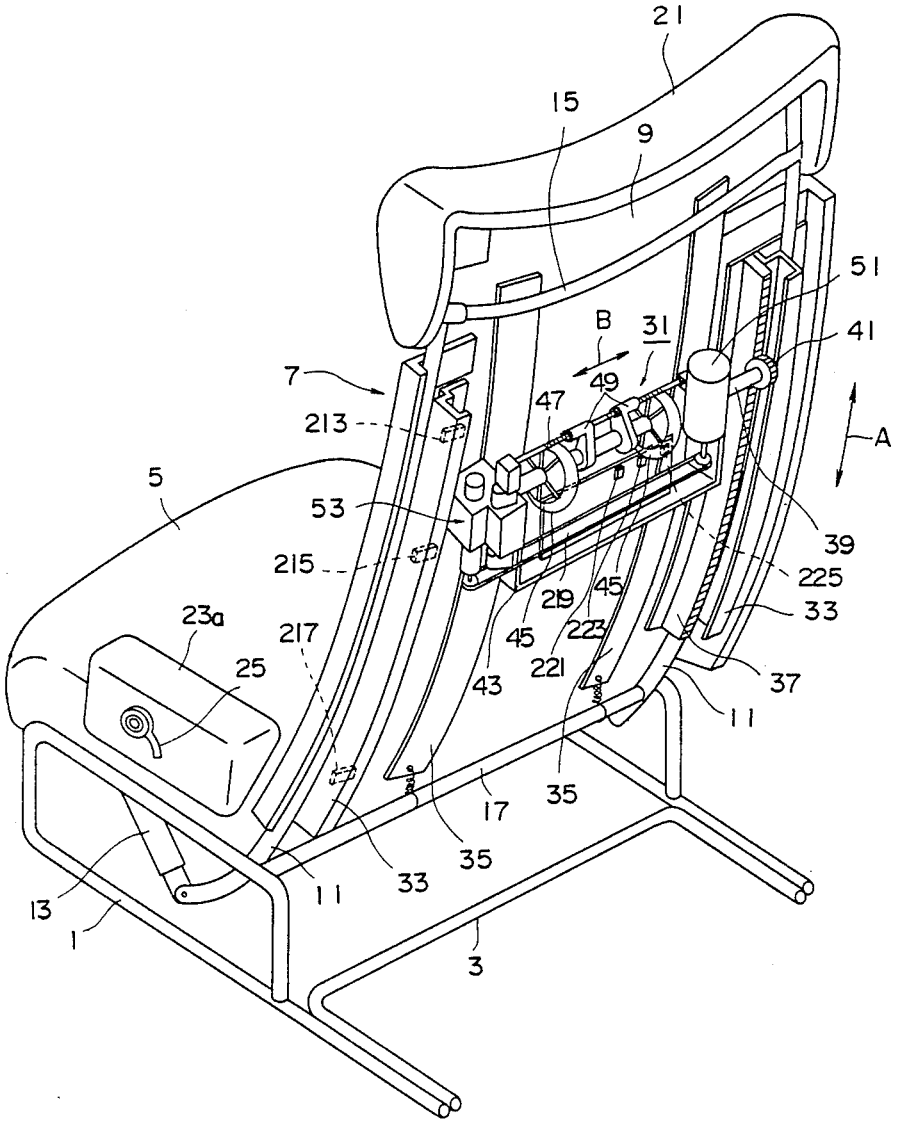
FIG. 12 shows other examples of the position detecting mechanism and spacing detecting mechanism.

FIG. 12 is a rear perspective view of an embodiment using contact type switches for detecting the upward/-downward directional position and spacing of the massaging wheels. In this embodiment, three limit switches 213, 215 and 217 are used for detecting the vertical position Y of the massaging wheels 45. These limit switches 213, 215 and 217 are installed along one rail 33 so that their actuators (not shown) may be turned on and off as by the gear box 53. When the limit switch 213 is turned on, the massaging wheels 45 are at the upper end position Y1; when the limit switch 215 is turned on, they are at the intermediate position Y2; and when the limit switch 217 is turned on, they are at the lower end position Y3. Further, limit switches 221, 223 and 225 are used to detect the spacing X of the massaging wheels 45. These limit switches 221, 223 and 225 are installed on a plate 219 fixed on the support frame 43 so that their actuators (not shown) may be turned on and off as by the connector arm 49. When the limit switch 221 is turned on, the spacing of the massaging wheels 45 is the minimum spacing X1; when the limit switch 223 is turned on, their spacing is the intermediate spacing X2; and then the limit switch 225 is turned on, their spacing is the maximum spacing X3. Thus, it will be understood that even if such contact type switches as limit switches are used, the vertical position and spacing can be detected. It goes without saying that the number of these limit switches may be increased or decreased as needed. For example, in the case of "STOMACH BACK MASSAGE", another limit switch will be provided for detecting the corresponding vertical position.

The massaging apparatus constructed in the manner described above can be operated by the operating unit 27, which is removably attached to the arm rest **23*b*, as described previously. This operating unit 27 is connected to the control circuit and power supply circuit installed in the chair (FIG. 1) through the connection cord 29. The operating unit 27 includes a three-position changeover switch 227 slidable to three positions, "STORE", "OPERATION" and "STOP". The operating unit 27 includes five selector switches 229, 231, 233, 235 and 237 for selecting different massage modes by the massaging wheels 45. The switch 229 is used to select "SPINE STRETCHING", and the switches 231, 233, 235 and 237 are used to select "NECK MASSAGE", "SHOULDER MASSAGE", "BACK MASSAGE" and "WAIST MASSAGE", respectively. These switches 229 or 237 are push switches and the operating unit 27 comprises a circuit responsive to these switches so that when one of them is turned on, the others are kept off. The operating unit 27 includes switches 239 and 241 for manually controlling the vertical position Y of the massaging wheels 45. These switches 239 and 241 are self-return type push switches designed to be kept on only while being pushed. The switch 239 is operated to shift the massaging wheels 45 further upwardly, while the switch 241 is operated to shift them further downwardly. The operating unit 27 includes switches 243 and 245 for manually controlling the spacing X of the massaging wheels 45. These switches 243 and 245 are self-return type push switches, the switch 243 being operated to increase the spacing of the massaging wheels 45 and the switch 245 to decrease it. The operating unit 27 includes 7 light emitting devices, e.g., light emitting diodes, 247 to 259. The light emitting device 247 is a pilot lamp adapted to be lighted when the power switch 295 (FIG. 16) is operated. The light emitting devices 249 to 257 are associated with the push switches 229 to 237 and adapted to be lighted when the associated push switches are turned on. The light emitting device 259 notifies the user of the apparaus being ready for operation as by going on and off until the apparatus starts a mode of operation selected by any one of the switches 229 to 237. This light emitting device 259 remains off during any other period. In addition, the operating unit 27 has a picture of the human body drawn thereon in connection with the push switches 229 to 237, and the light emitting devices 251 to 257 arranged on said picture. For example, the light emitting device 251 corresponding to the push switch 231 for neck message is positioned at the neck of the human body picture. This arrangement gives clear information of what massage mode has been selected now. Further, the switches 239 and 241** are in the form of a triangle and an inverted triangle, respectively, so that the direction of their vertical movement can be easily visualized.

Such operating unit 27 is removable from the arm rest, and is within easy reach of the user sitting in the chair. As a result, the operating unit is very easy to operate as compared with such unit permanently fixed.

Figure 15:
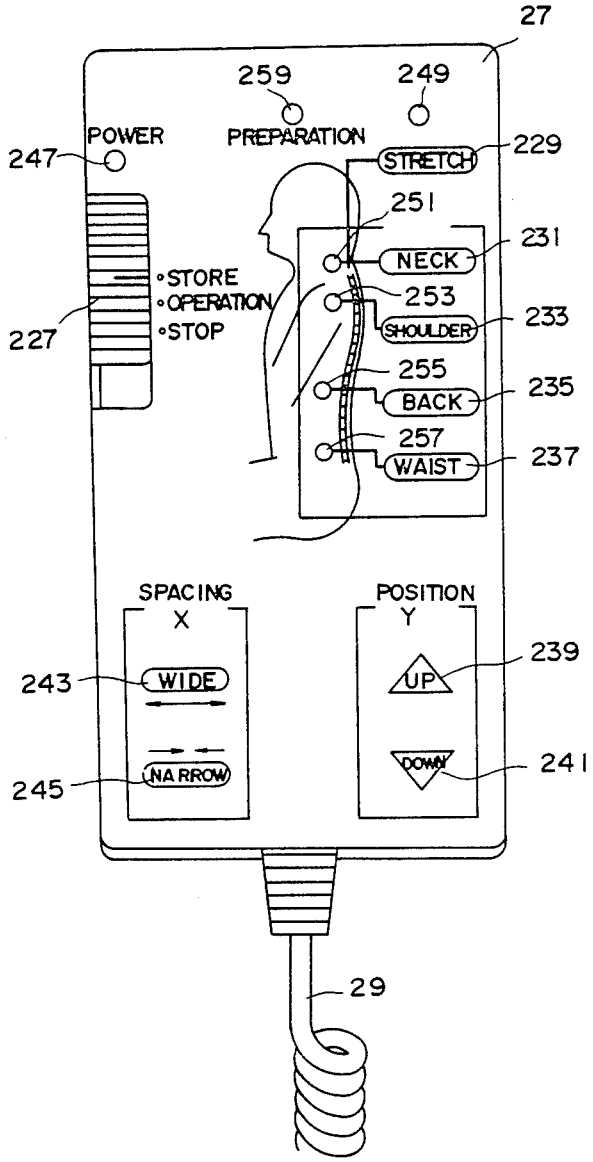
FIG. 15 is a diagrammatic view showing an example of an operating unit.
Figures 16, 16A:
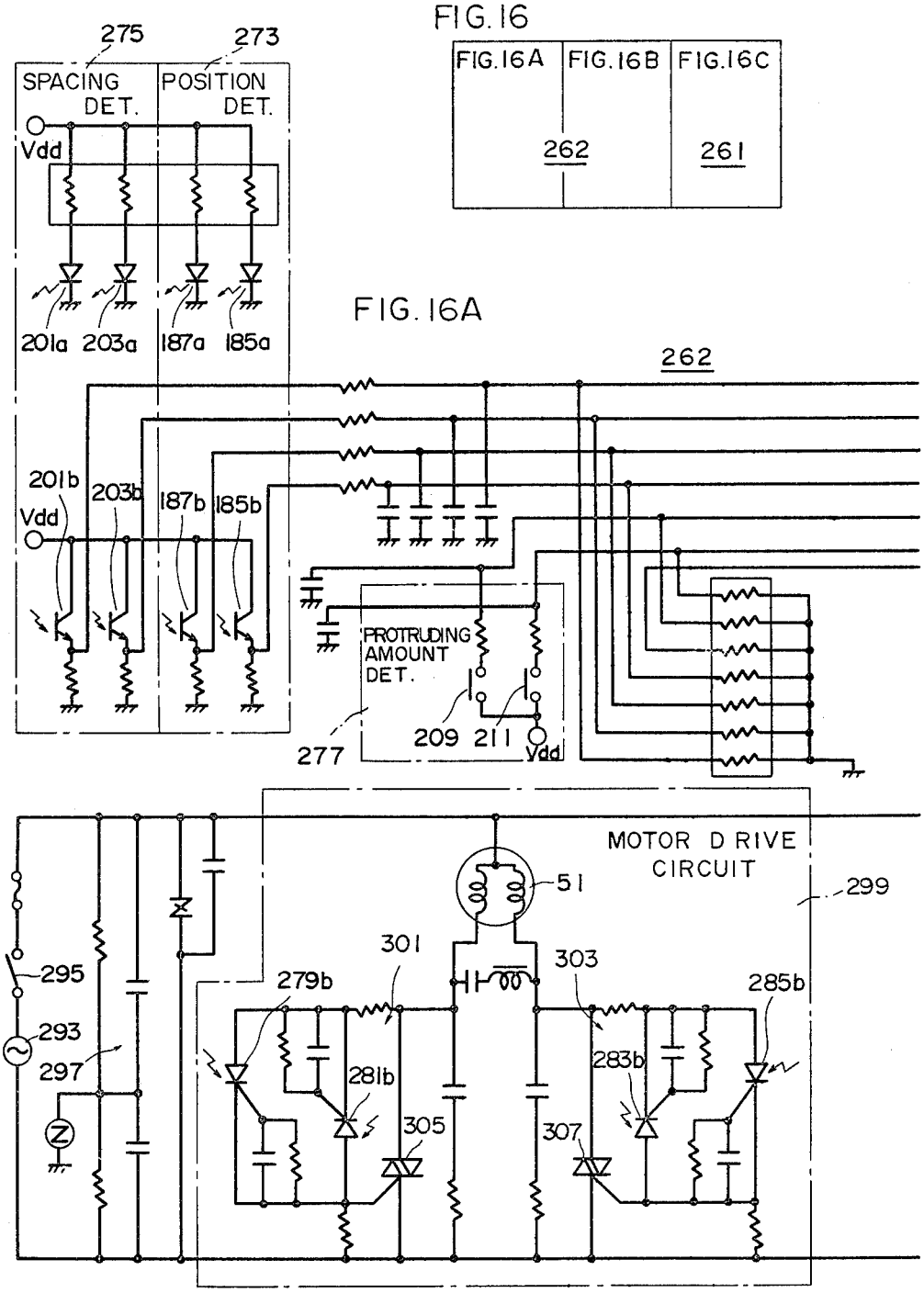
FIG. 16 is a circuit diagram showing an embodiment of the invention.
Figure 16B:
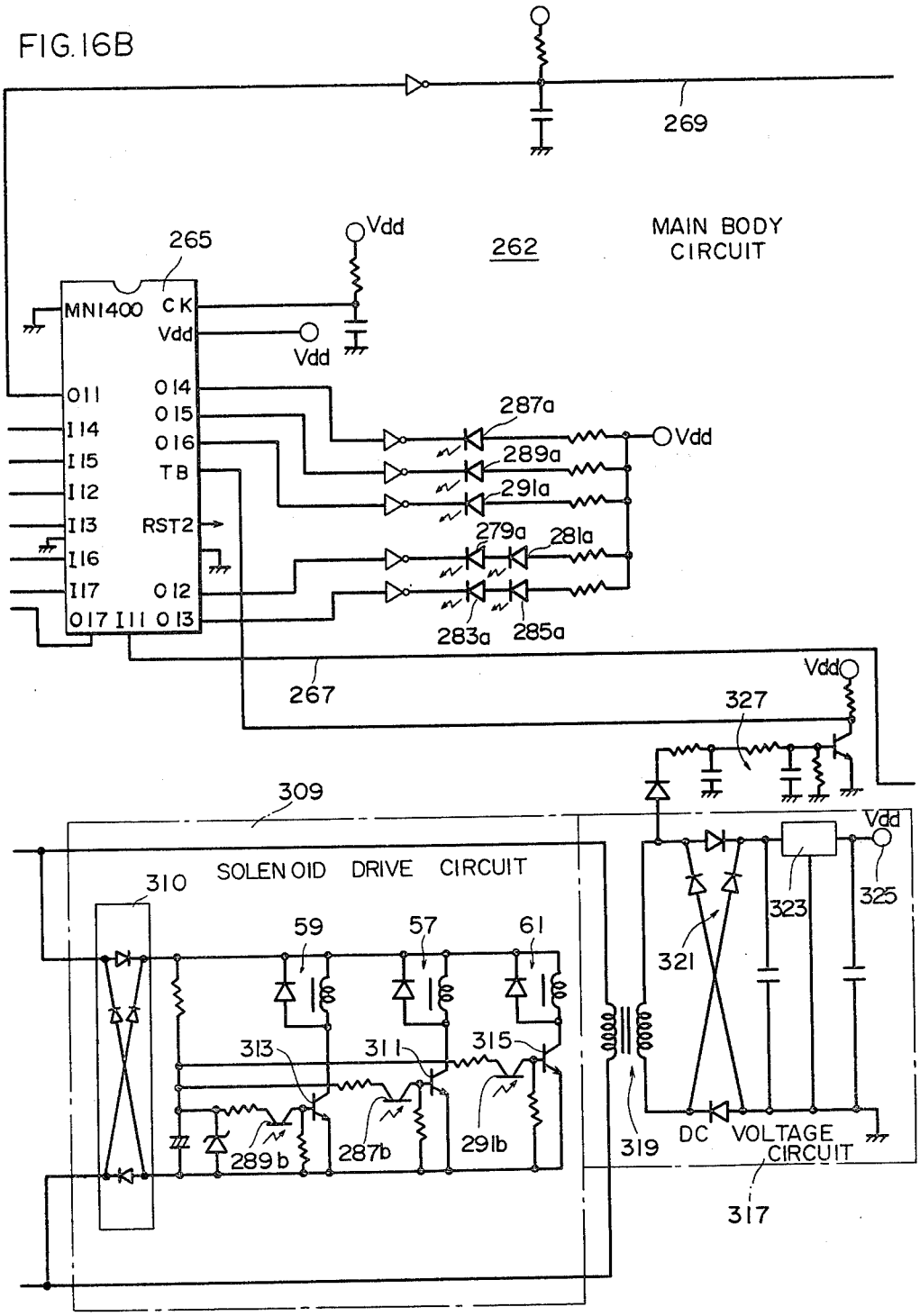
Figure 16C:
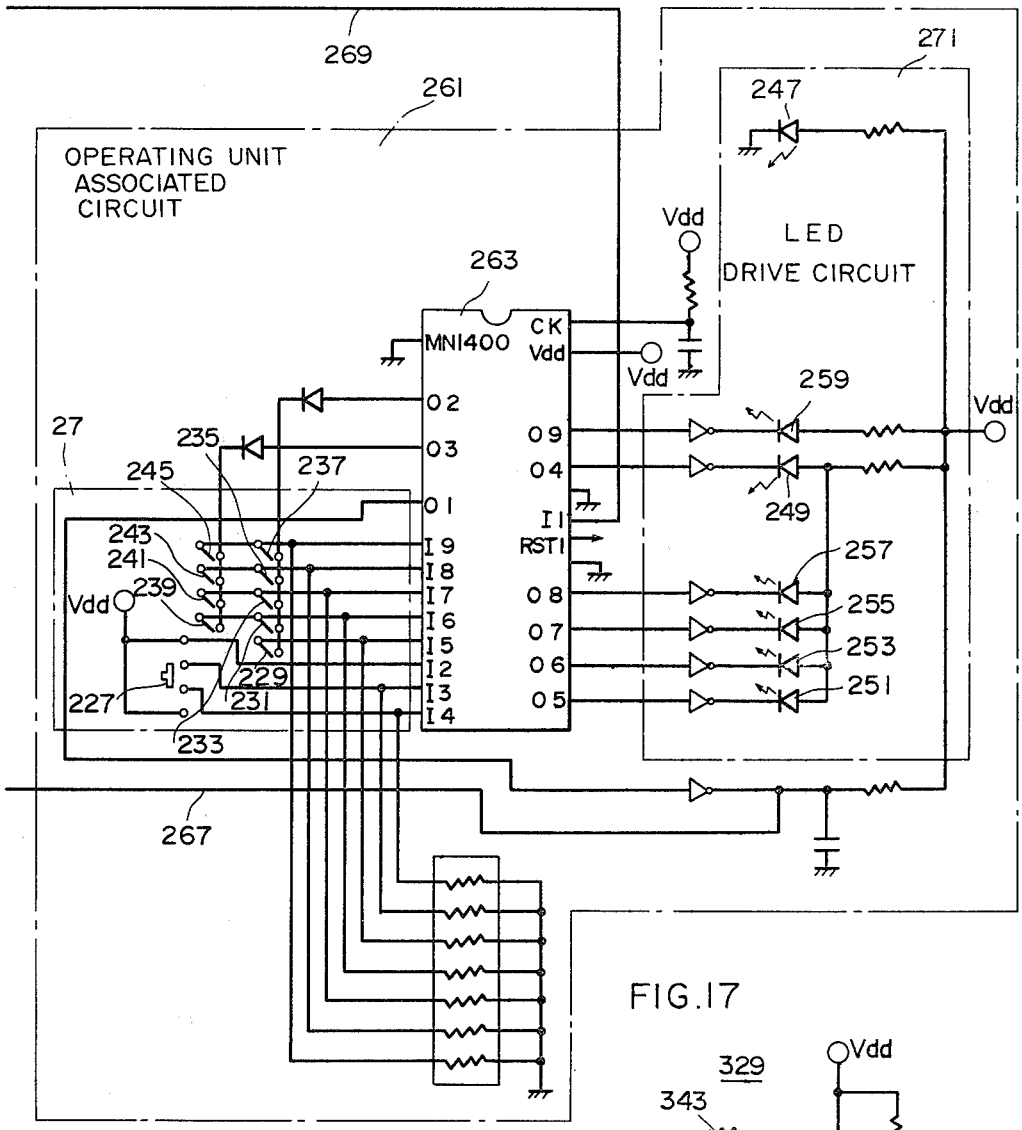

FIG. 16 is a schematic diagram of one example of the inventive control circuit. The control circuit comprises an operating unit associated circuit 261 and a main body circuit 262. The operating unit associated circuit 261 comprises a microprocessor 263 housed in the operating unit 27 (FIG. 15). A main body circuit 262 is mounted in the back rest 7 (FIG. 1) of the chair, for example, and comprises a microprocessor 265. Thus, the embodiment shown employs two microprocessors 263 and 265, which makes it more convenient to make the operating unit 27 detachable from the chair. More specifically, in order to make an operating unit including a number of switches detachable from the chair, it is necessary to connect the respective switches to the control circuit provided in the main body by means of independent signal wires. However, connection of the respective switches by the independent signal wires considerably increases the number of such signal wires, which makes a connection cord too thick to bring the operating unit 27 freely to a desired position, with the result that convenience of operation is degraded. Meanwhile, an approach might be considered in which transfer of data and control signals is carried out between the operating unit 27 and the main body circuit by wireless. However, in such a case an inconvenience is involved that both the operating unit 27 and the main body circuit need be provided with a power supply. Therefore, the embodiment shown employs the two microprocessors 263 and 265, which are provided in the operating unit and the chair main body such that both are connected by two signal lines 267 and 269 for communication of data signals. Accordingly, merely two data signal lines 267 and 269 plus two power lines need be provided between the chair main body and the operating unit 27 as connection wires. Therefore, according to the embodiment shown only a spiral connection cord 29 (FIG. 15) of four strands need be connected between the operating unit 27 and the chair main body. Since the connection cord 29 may be of a spiral type and may be thin, convenience of operation of the operating unit 27 is more enhanced.

The microprocessor 263 included in the operating unit associated circuit 261 comprises input terminals I1 to I9, output terminals O1 to O9, a power supply terminal Vdd, a clock terminal CK and a reset terminal RST1. The input terminal I1 is connected to a data signal line 269, thereby to receive the data signal from the output terminal O11 of the other microprocessor 265. The input terminals I2 to I4 receive signals associated with a slide switch 227 provided in the operating unit 27. Accordingly, the microprocessor 263 determines that the slide switch 227 is at the "STORE" position when both of the input terminals I2 and I3 are at the high level. Likewise, the microprocessor 263 determines that the switch 227 is at the "OPERATION" position when the input terminal I2 is at the high level and both of the input terminals I3 and I4 are at the low level and further determines that the switch 227 is at the "STOP" position when both the input terminals I2 and I4 are at the high level. The input terminals I5 to I9 receive signals associated with switches 229 to 245 provided in the operating unit 27. More specifically, these switches 229 to 245 constitute a key matrix such that the group of the switches 229 to 237 receives the signal from the output terminal O2 of the microprocessor 263 and the group of the switches 239 to 235 receives the signal from the output terminal O3. Accordingly, the microprocessor 263 determines that the switch 237 is manually operated responsive to reception of the high level signal from the input terminal I9 when the signal is obtained from the output terminal O2. Even when the high level signal is obtained from the input terminal I9, the microprocessor 263 determines that the switch 245 is operated insofar as the signal is obtained from the output terminal O3. The output terminal O1 is connected to the data signal line 267 for the purpose of supplying the data signal from the microprocessor 263 to the input terminal I11 of the other microprocessor 265. The output terminals O4, O5 to O8 and O9 are connected to light emitting devices 249, 251 to 257 and 259, respectively. Accordingly, when the high level signal is obtained from the output terminal O4, the voltage Vdd is applied to the light emitting device 249, whereby light is emitted from the light emitting device 249. These light emitting devices 249 to 259 as well as the light emitting device 247 for indicating turning on of the power supply are included in the light emitting device driving circuit 271.

The main body circuit 262 comprises a position detecting circuit 273 for detecting the vertical position, i.e. upward/downward directional position Y of a pair of massaging wheels, a spacing detecting circuit 275 for detecting the spacing X between the pair of massaging wheels, and a protruding amount detecting circuit 277 for detecting the protruding amount Z from the main shaft of the pair of massaging wheels. The position detecting circuit 273 comprises light emitting devices 185*a* and 187*a* and light receiving devices 185*b* and 187 *b* constituting the photoelectric switches 185 and 187 (FIG. 7), respectively. The spacing detecting circuit 275 comprises light emitting devices 201*a* and 203*a* and light receiving devices 201*b* and 203*b* constituting photoelectric switches 201 and 203 (FIG. 10), respectively. These light receiving devices 185*b*, 187*b*, 201*b* and 203*b* of such as phototransistors are rendered conductive responsive to receipt of a light beam from the corresponding light emitting devices 185*a*, 187*a*, 201*a* and 203*a*, thereby to provide the high level signal at each of the emitters thereof. The outputs from these light receiving devices 185*b*, 187*b*, 201*b* and 203*b* are applied to the input terminals I12, I13, I14 and I15 of the microprocessor 265 included in the main body circuit 262. The protruding amount detecting circuit 277 comprises reed switches 209 and 211 (FIG. 3), so that the signals from these reed switches 209 and 211 are applied to the input terminals I16 and I17 of the microprocessor 265.

The microprocessor 265 receives the data signal from the microprocessor 263 included in the operating unit 27 through the data signal line 267 and sends the data signal to the microprocessor 263 through the data signal line 269. More specifically, the microprocessor 265 is responsive to the detected signal from the input terminals I12 to I17 to provide the data signal representing the state of the massaging machine at that time to the input terminal I1 of the microprocessor 263 through the output terminal O11 and the signal line 269. The microprocessor 263 is responsive to the signal representing the operation state of the switches from the input terminals I2 to I9 to provide the data signal representing the state of the respective switches 227 to 245 to the input terminal I11 of the microprocessor 265 through the output terminal O1 and the signal line 267. At that time the respective microprocessors 263 and 265 transmit repetitively several times the pulse code data constituted by four bits with an intermission period there between. In receiving the data signal, if and when the data signals repetitively transmitted several times as described above are all consistent with each other, then the microprocessors 265 and 263 latches the same, thereby to treat the same as a proper input data signal. Meanwhile, such determination proper input data signal may be performed by employing the majority principle, for example, as well-known to those skills in the art. At any rate, a chance of malfunction due to a noise, for example, is reduced as much as possible. The microprocessor 265 is responsive to the data signal transmitted from the microprocessor 263, as described above, to provide the high level output at any one of a plurality of the output terminals O12 to O16, as necessary. These output terminals O12, O13, 014, O15 and O16 are connected to the light emitting devices 279*a*, 218*a*, 283*a*, 285*a*, 287*a*, 289*a* and 291*a*. For example, if and when the high level signal is obtained from the output terminal O12, the voltage Vdd is applied to the two light emitting devices 279*a* and 281*a*, whereby these light emitting devices 279*a* and 281*a* emit light simultaneously. These light emitting devices 279*a* to 291*a* are photocoupled to the light receiving devices 279*b* to 291*b*, whereby photocouplers are constituted through cooperation thereof. For example, when the light emitting devices 279*a* and 281*a* emit light, the light therefrom are applied to the phototriacs 279*b* and 281*b* included in a motor driving circuit 299. Accordingly, these phototriacs 279*b* and 281*b* are rendered conductive. By taking another example, the light from the light emitting device 289*a* is applied to the phototransistor 289*b* included in the solenoid driving circuit 309, whereby the phototransistor 289*b* is rendered conductive responsive to light emission from the light emitting device 289*a*.

The main body circuit 262 comprises a power supply switch 295 connected to the alternating current power supply 293. The alternating current power supply 293 is connected to a bypass circuit 297 including two surge absorbers, three capacitors and two resistors, which bypass circuit 297 serves to bypass to the ground a surge current caused by a noise, static electricity or the like. The motor driving circuit 299 is connected to the alternating current power supply 293 through a power supply switch 295.

The motor driving circuit 299 comprises a reversible motor 51 (FIG. 3), a forward rotating circuit 301 for causing a current to flow for rotating the motor in the forward direction and a reverse rotating circuit 303 for causing a current to flow for rotating the motor 51 in a reverse direction. The forward rotating circuit 301 comprises two chip phototriacs 279*b* and 281*b* photocoupled to the above described light emitting devices 279*a* and 281*a*. When the phototriacs 279*b* and 281*b* are rendered conductive, a gate voltage is applied to the gate of the triac 305 and accordingly a current flows through one field winding of the motor 51 through the forward rotating circuit 301. Thus the motor 51 is rotated in the forward direction. The reverse rotating circuit 303 comprises two chip phototriacs 283*b* and 285*b* photocoupled to the light emitting devices 283*a* and 285*a*. The triac 307 is rendered conductive responsive to conduction of these phototriacs 283*b* and 285*b*, whereby the motor 51 is rotated in the reverse direction.

A solenoid driving circuit 309 is connected to the alternating current power supply 293 through the power supply switch 295. The solenoid driving circuit 309 comprises the respective solenoids of the electromagnetic brakes 57 and 59 and the electromagnetic clutch 61 (FIG. 3). A solenoid driving voltage is obtained from the full-wave rectifying circuit 310. The respective solenoids of the electromagnetic brakes 57 and 59 and the electromagnetic clutch 61 constitute series connections with transistors 311 and 313 and 315, such that these series connections each receive a solenoid driving voltage from the full-wave rectifying circuit 310. The respective bases of these transistors 311, 313 and 315 are connected to light receiving devices 287*b*, 289*b*, and 291*b* of such as phototransistors photocoupled to the previously described light emitting devices 287*a*, 289*a* and 291*a*, respectively. For example, when the light emitting device 289*a* emits light, then the light receiving device 289*b* is accordingly rendered conductive, whereby the transistor 313 is rendered conductive and the solenoid of the electromagnetic brake 59 is energized.

A direct current voltage circuit 317 is connected through the power supply switch 295 to the alternating current power supply 293. The direct current voltage circuit 317 comprises a step-down transformer 319 and a full-wave rectifying circuit 321 for rectifying the secondary voltage of the step-down transformer 319. The direct current voltage obtained from the full-wave rectifying circuit 321 is withdrawn from the power supply terminal 325 as a direct current power supply voltage Vdd of say 5 volt by a three terminal regulator 323. The power supply terminal 325 and the ground line are connected to the power supply terminal and the ground of the operating unit associated circuit 261 by means of the connection cord 29. A time base signal circuit 327 is provided associated with the direct current voltage circuit 317. More specifically, a time base signal circuit 327 receives the secondary voltage of the step-down transformer 319, thereby to provide a pulsive signal at each cycle of the alternating current, whereby the pulsive signal is applied to the terminal TB of the microprocessor 265 as a time base signal. The microprocessor 265 determines a repetitive transmission period of the data signal based on the time base signal applied to the terminal TB or obtain a predetermined operation delay time and further calculates a timer time period to be described subsequently.

Figure 17:
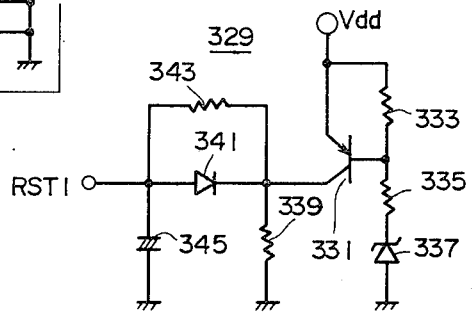
FIG. 17 is a schematic diagram showing an example of a reset circuit.

The microprocessors 263 and 265 comprise the respective reset terminals RST1 and RST2. The reset terminals RST1 and RST2 are connected to separate reset circuits. FIG. 17 shows a reset circuit 329 connected to the reset terminal RST1 but the reset circuit being connected to the reset terminal RST2 can also be structured in the same manner. The reset circuit 329 comprises a transistor 331 having the emitter connected to the voltage Vdd. The base of the transistor 331 is connected through a resistor 333 to the voltage Vdd and is also connected to the ground through a resistor 335 and a zener diode 337. The collector of the transistor 331 is connected to the ground through a resistor 339 and is also connected to the reset terminal RST1 through a parallel connection of the diode 341 and the resistor 343. The other end of the parallel connection is connected to the ground through a capacitor 345. If and when the voltage Vdd is raised to 5 volt, for example, then the potential at the emitter of the transistor 331 is increased and if and when the same increases to exceed a predetermined value as compared with the base voltage determined by the zener diode 337, then the transistor 331 is rendered conductive. Accordingly, the capacitor 345 is charged through the transistor 331 and the resistor 343. Therefore, a set signal of the high level is applied to the reset terminal RST1 with a predetermined delay time from the turning on of the power supply. If and when the power supply voltage Vdd disappears and if and when the voltage Vdd is decreased to a predetermined value determined by the zener diode 337, then the transistor 331 is rendered non-conductive, whereby the capacitor 345 is discharged through the diode 341 and the resistor 339. Accordingly, when the power supply voltage Vdd disappears, a reset signal of the low level is rapidly applied to the reset terminal RST1. Thus the microprocessor 263 is reset.

Figure 18:
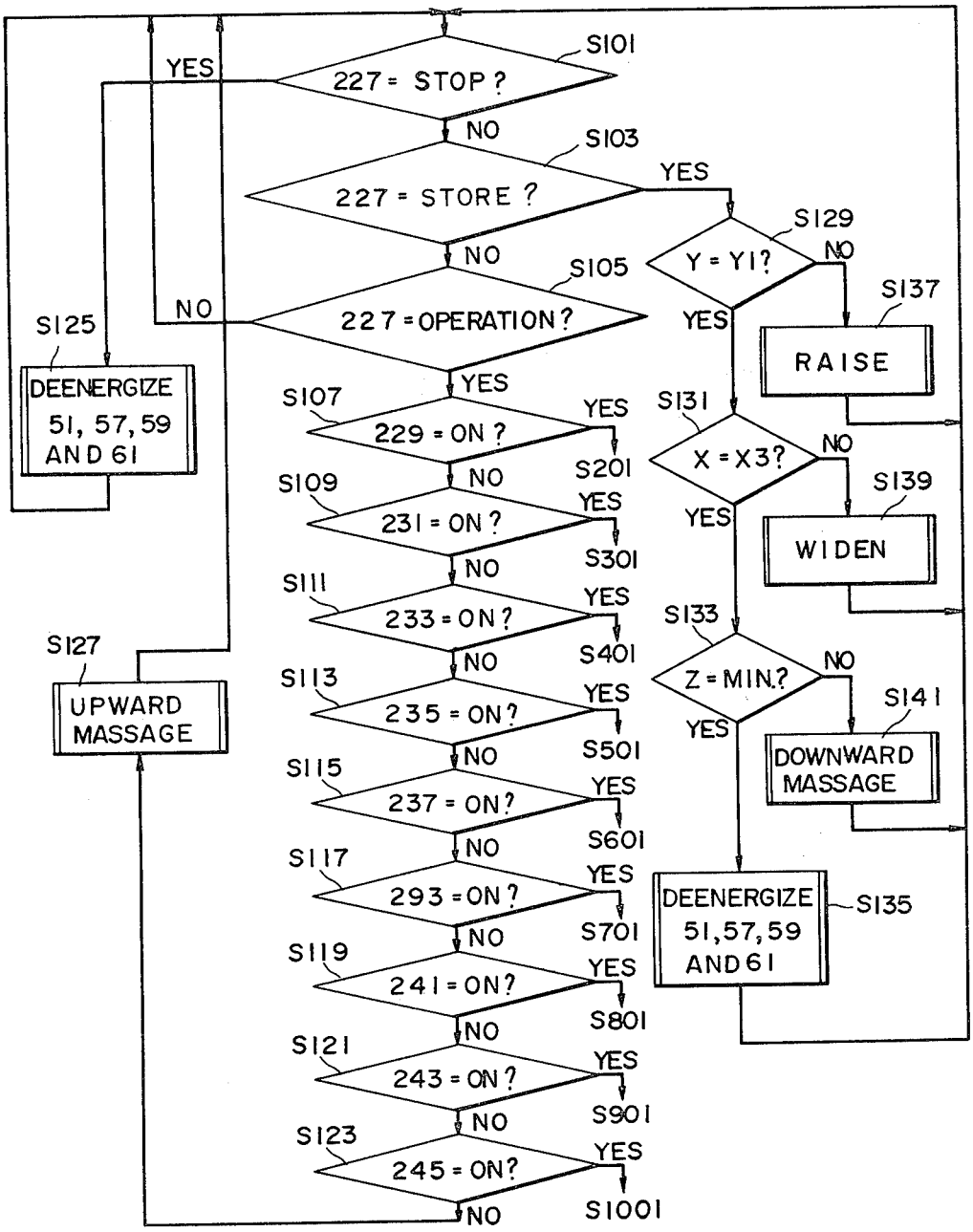
FIGS. 18 through 28 are flow diagrams illustrating the operation of the embodiment shown in FIG. 16.
Figure 19:
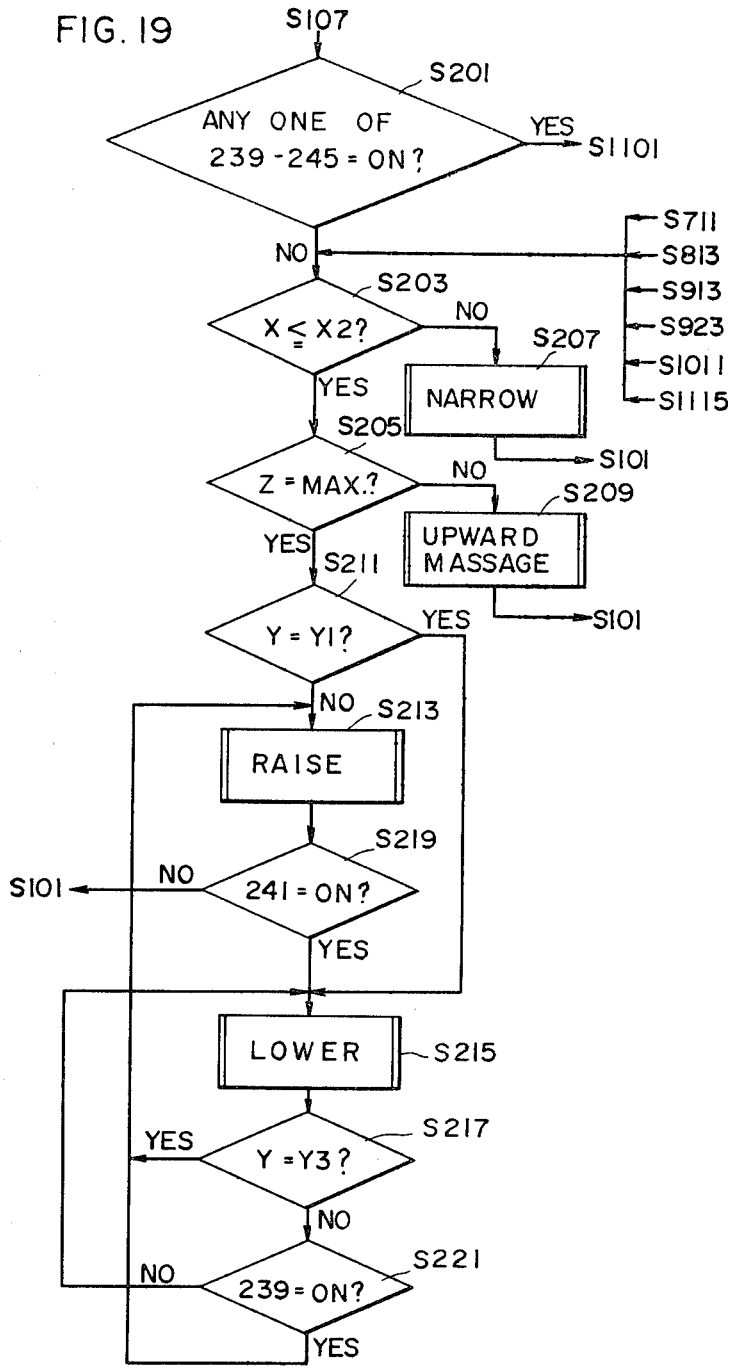
Figure 20:
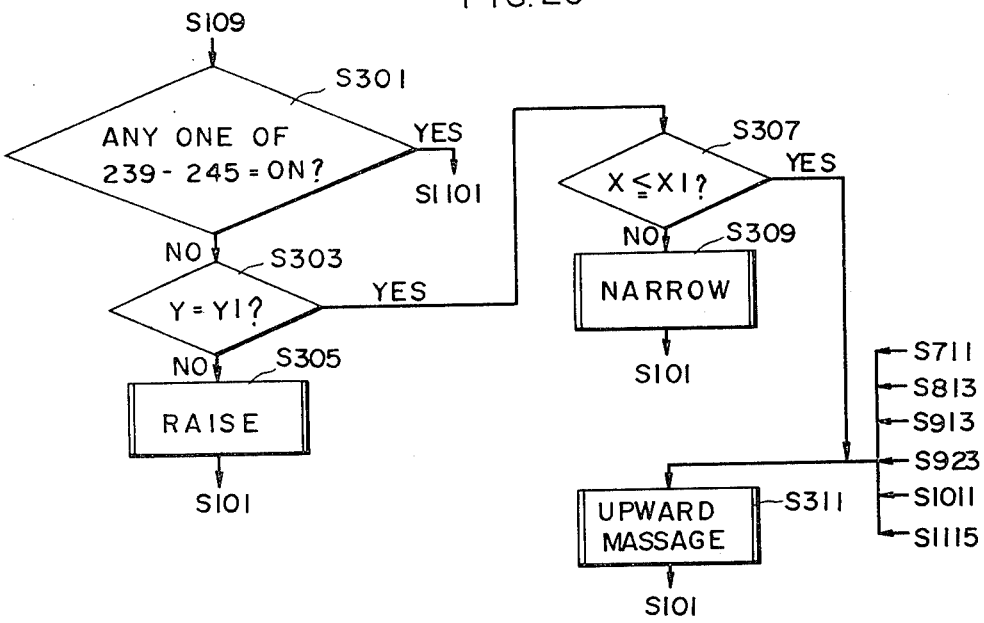
Figure 21:
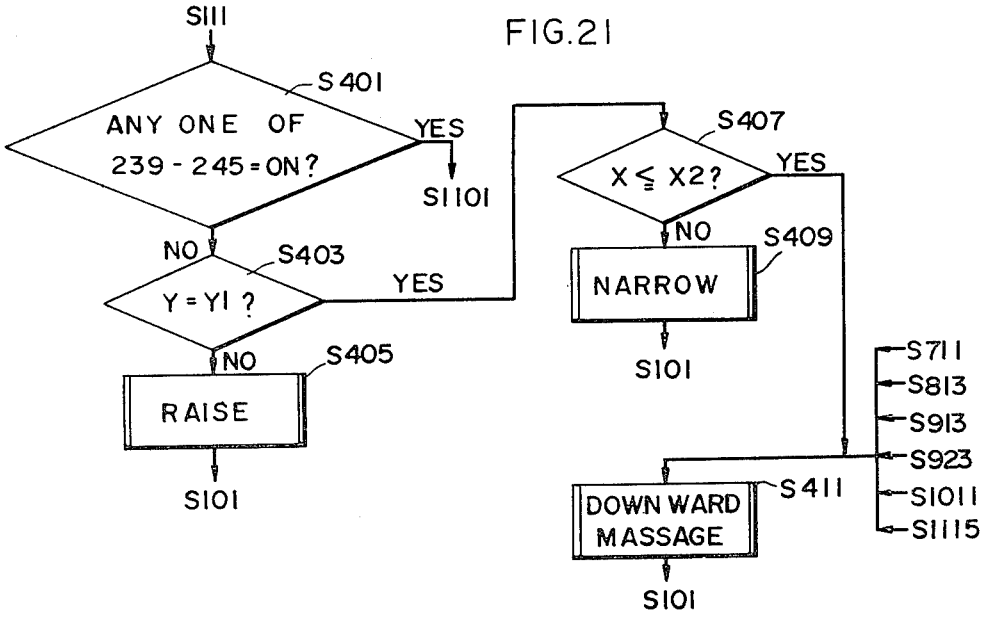
Figure 22:
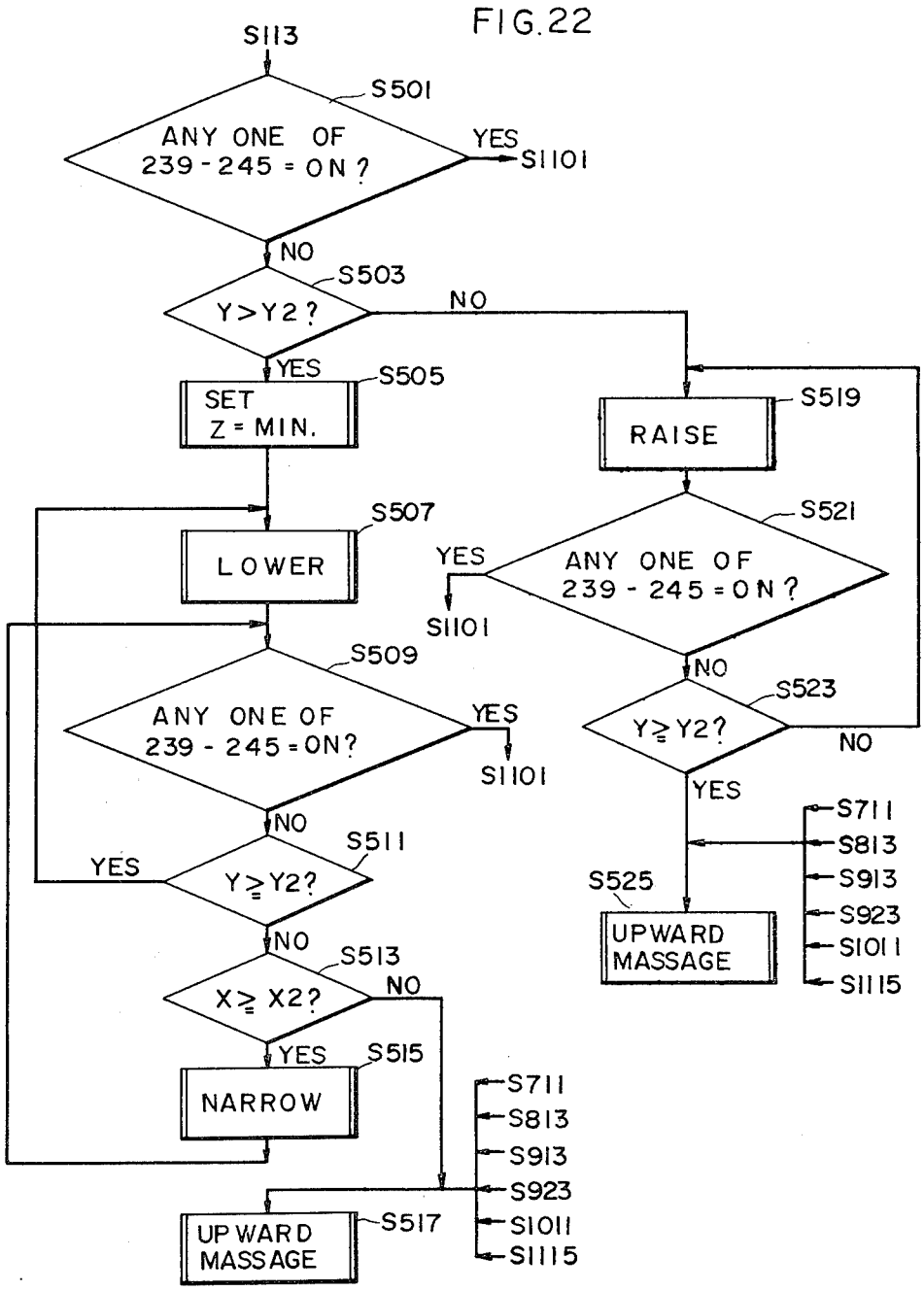
Figure 23:
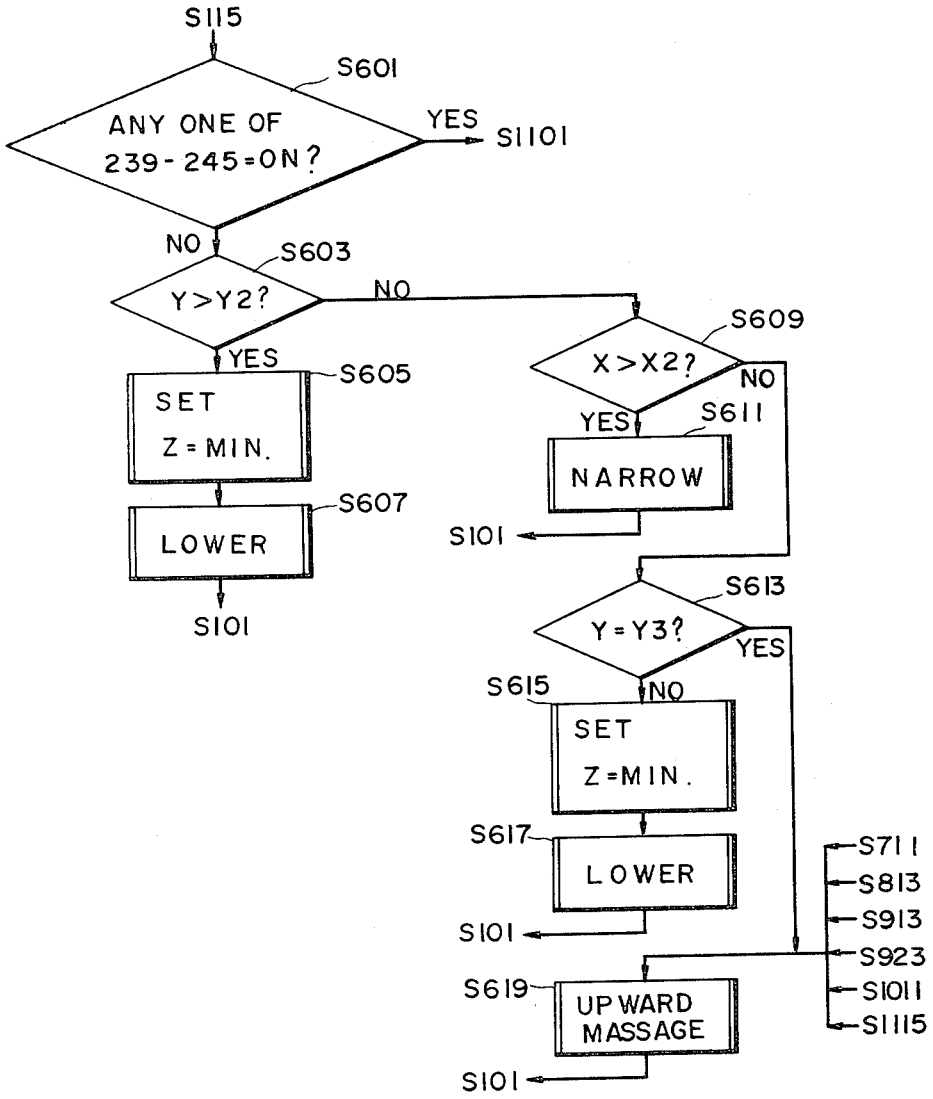
Figure 24:
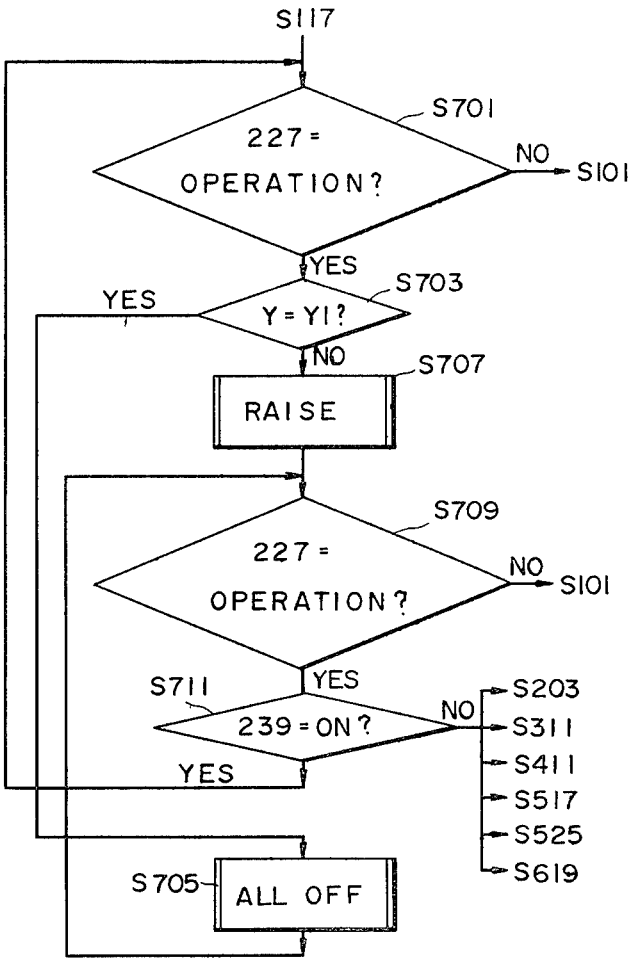
Figure 25:
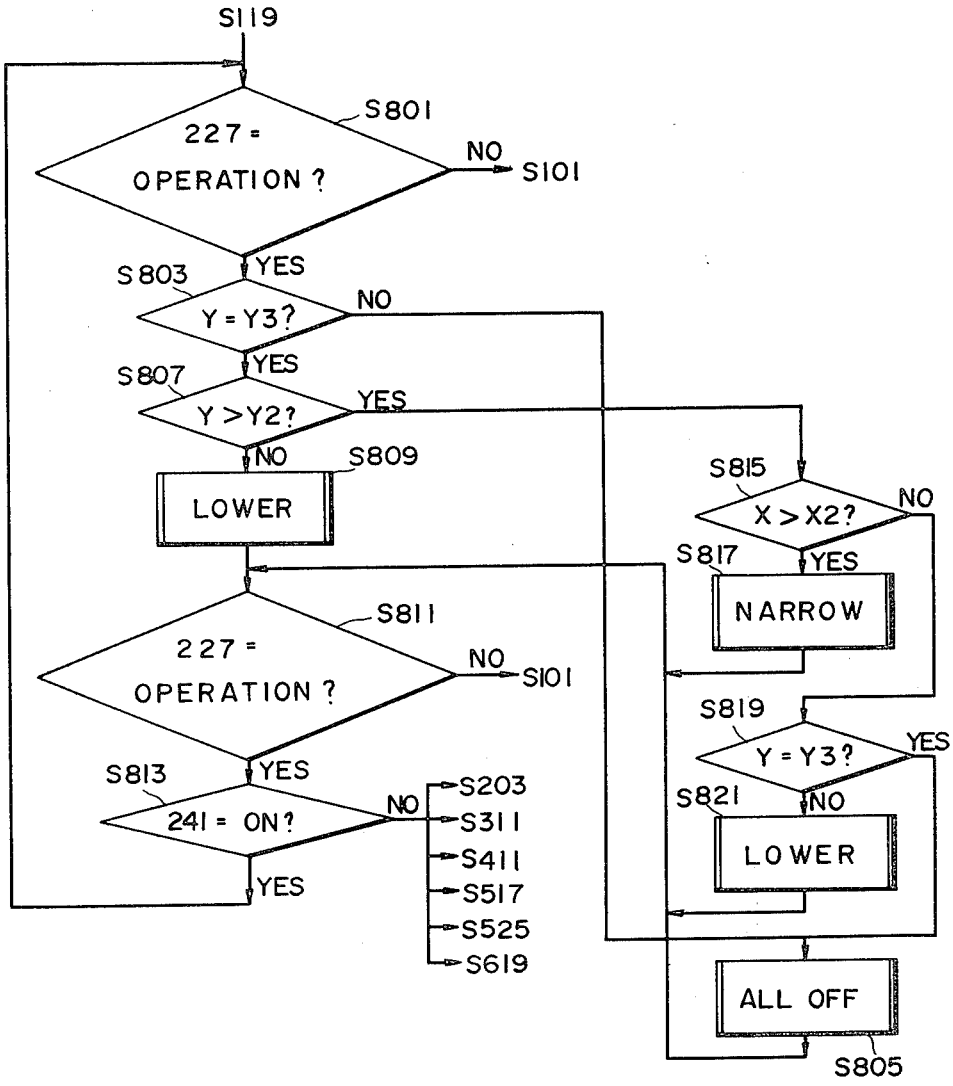
Figure 26:
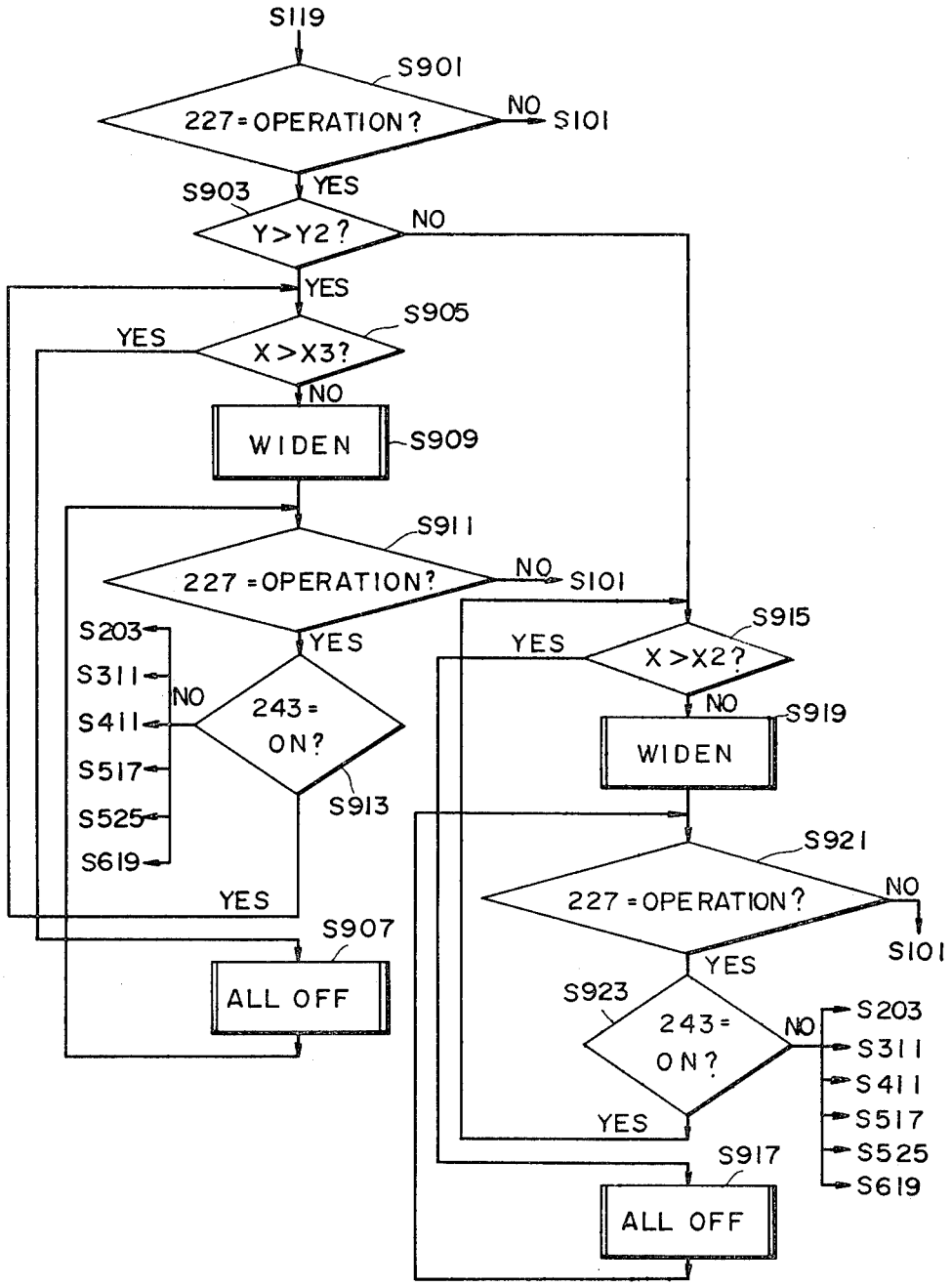
Figure 27:
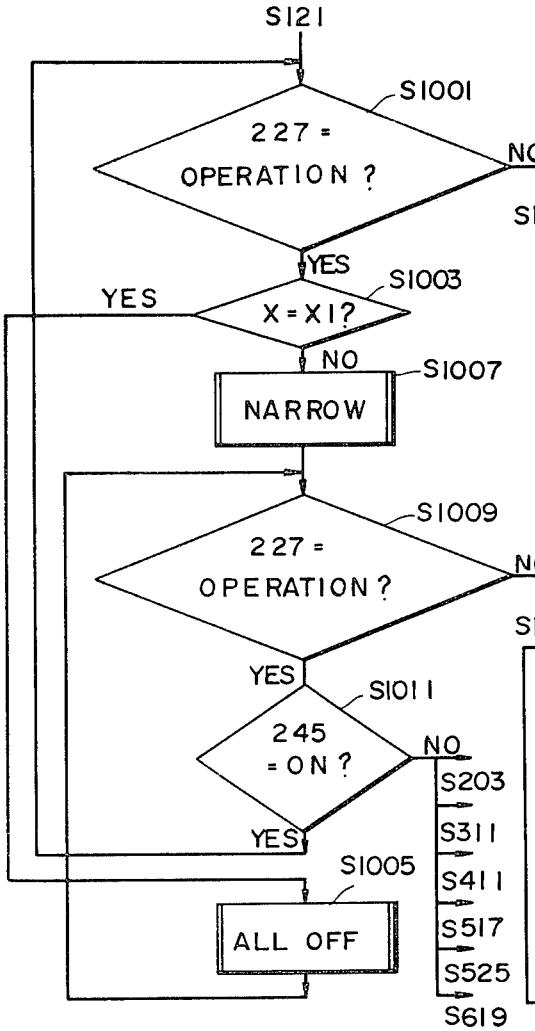
Figure 28:
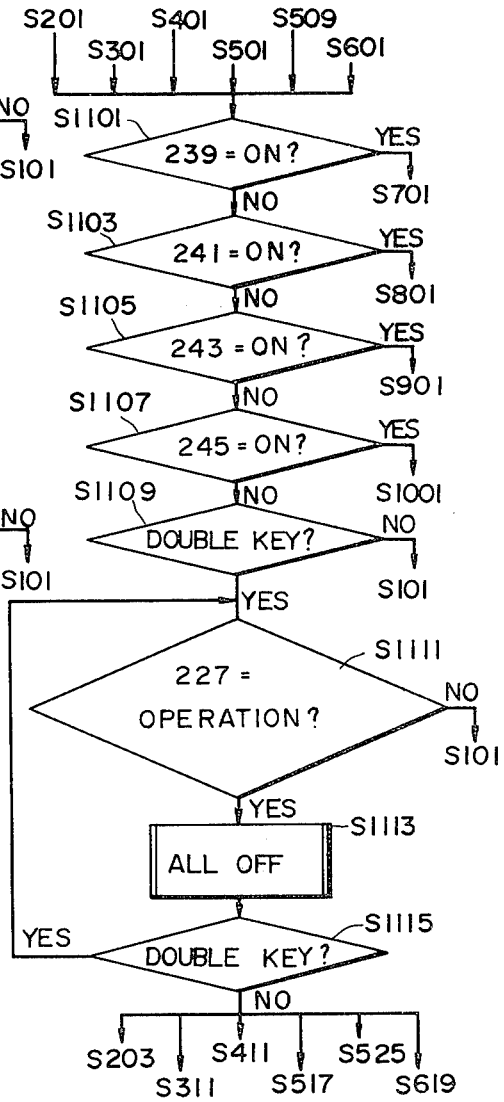

FIGS. 18 to 28 are flow diagrams for explaining the operation of the FIG. 16 embodiment. FIG. 19 shows an operation in the case where the switch 229 is operated, FIG. 20 shows an operation in the case where the switch 231 is operated, FIG. 21 shows an operation in the case where the switch 233 is operated, FIG. 22 shows an operation in the case where the switch 235 is operated, and FIG. 23 shows an operation in the case where the switch 237 is operated. FIG. 24 shows an operation in the case where the switch 239 is operated, FIG. 25 shows an operation in the case where the switch 241 is operated, FIG. 26 shows an operation in the case where the switch 243 is operated, FIG. 27 shows an operation in the case where the switch 245 is operated, and FIG. 28 shows an operation in the case where interruption is made from the switch 239, 241, 243 or 245. Now referring to FIGS. 15 and 16 and 18 to 28, the operation of the embodiment shown will be described. Meanwhile, in the following description symbols are used in connection with the position Y such that the equality symbol (=) represents that the pair of massaging wheels exist at the respective position Y1, Y2 or Y3 and the inequality symbol (Y>Y2) represents that the pair of massaging wheels exist at the position upper than that position. The symbols are also utilized in connection with the distance such that the equality symbol (=) represents the spacing X1, X2 or X3 between the pair of massaging wheels and the inequality symbol (X< or X>) represents that the spacing between the pair of massaging wheels is smaller than the spacing X1 or X2 or larger than the spacing X2 or X3.

When the power supply switch 295 is turned on, accordingly the direct current voltage Vdd of say 5 volt is obtained at the power supply terminal 325 of the direct current voltage circuit 317. Accordingly the light emitting device 247 included in the light emitting device driving circuit 271 of the operating unit associated circuit 261 emits light upon application of the voltage Vdd. Thus, the turning on of the power supply is notified.

Upon turning on of the power supply, the microprocessor 265 determines at the steps S101 to S123 shown in FIG. 18 what position the switch 227 is located and which one of the switches 229 to 245 is operated. More specifically, the microprocessor 263 is responsive to the turning on of the power supply to receive the set signal from the reset circuit 329 (FIG. 17). The microprocessor 263 is responsive to the input signal from the input terminals I2 to I9 to determine the position of the switch 227 and the operation of the switches 229 to 245 and to send the data signal to the microprocessor 265. In the case where both of the input terminals I2 and I4 are the high level, it is determined that the switch 227 is at the position of "STOP" at the step S101. Accordingly, the microprocessor 265 turns all the output terminals P12 to P16 to the low level, thereby to turn off all the light emitting devices 279*a* to 291*a*, thereby to deenergize at the step S125 all the motor 51, the electromagnetic brakes 57 and 59 and the electromagnetic clutch 61.

The microprocessor 263 determines at the step S103 that the switch 227 is at the position of "STORE" when both of the input terminals I2 and I3 are the high level. Thus, if and when the switch 227 is at the position of "STORE", the microprocessor 265 performs a control operation associated therewith to be set forth in the following. If and when the massaging apparatus has been already brought to a storing state, the microprocessor 265 deenergizes at the step S135 all of the motor 51, the electromagnetic brakes 57 and 59 and the electromagentic clutch 61, just as done at the previous step S125. Meanwhile, the fact that the massaging apparatus is in the storing state means a situation in which the pair of massaging wheels 45 (FIG. 3) have been brought to the upper end portion Y1 in the vertical direction, the spacing between the pair of massaging wheels are the maximum X3 and the protruding amount Z of the pair of massaging wheels is the minimum. At the step S129 the microprocessor 265 refers to the signal of the input terminals I12 and I13 to determine whether both of the photoelectric switches 185 and 187 are turned on, i.e. whether Y=Y1. At the step S131 the microprocessor 265 refers to the signal of the input terminals I14 and I15 to determine whether both of the photoelectric switches 201 and 203 are turned off, i.e. whether X=X3. At the step S133 the microprocessor 265 refers to the signal of the input terminals I16 and I17 to determine whether the read switch 211 is turned on, i.e. whether Z=the minimum. If and when the decision is made as "YES" at any one of the steps S129, S131 and S133, this means that the massaging apparatus has already been brought to the storing state and the program proceeds to the step S135. In the case where the apparatus is not in the storing state, the data signal is transferred from the microprocessor 265 to the microprocessor 263 and accordingly the microprocessor 263 provides a repetition of the pulse signals to the output terminal O9. Accordingly, the light emitting device 259 connected to the terminal O9 is turned on intermittently or in a blinking manner and accordingly indication is made to a user that a preparatory operation has been made for the purpose of a storing operation. If decision is made as "NO" at the step S129, the microprocessor 265 provides the high level signal at the output terminal O13. Accordingly, the reverse rotating circuit 303 included in the motor driving circuit 299 is rendered conductive, whereby the motor 51 is rotated in the reverse direction. At that time the high level signal is obtained simultaneously from the output terminal O15. Accordingly, the transistor 313 included in the solenoid driving circuit 309 is rendered conductive and the solenoid of the electromagnetic brake 59 is energized and hence a worm shaft 97 (FIG. 3) is braked. Accordingly, the shifting shaft 69 (FIG. 4) is driven for rotation and the main shaft 39 and thus the pair of massaging wheels 45 are brought to the upper most position Y1. Meanwhile, it is in advance pointed out that in the respective operations to be described subsequently the operation "RAISE" for moving upward the pair of massaging wheels is performed in the same manner as that at the step S137. If and when decision is made as "NO" at the step S131 the microprocessor 265 provides the high level signal at the output terminal O13, whereby the motor 51 is rotated in the reverse direction. At the same time the microprocessor 265 provides the high level signal at the output terminals O14 and O16. Accordingly, the light emitting devices 287*a* and 291*a* are lighted and the transistors 311 and 315 included in the solenoid driving circuit 309 are rendered conductive, whereby the solenoid of the electromagnetic brake 57 and the solenoid of the electromagnetic clutch 61 are both energized. Accordingly, the feed shaft 47 (FIG. 3) is rotated and the spacing X between the pair of massaging wheels is made to be the maximum X3. Meanwhile, it is in advance pointed out that at the respective operations to be described subsequently the operation "WIDEN" for widening the spacing between the pair of massaging wheels is performed in the same manner as that at the step S139. If and when decision is made as "NO" at the step S133 the microprocessor 265 provides the high level signal at the output terminals O13 and O14. Accordingly, the motor 51 is brought to the reverse rotating state and the pair of massaging wheels are rotated in the downward massaging direction, while the protruding amount Z is made minimal. Meanwhile, it is in advance pointed out that at the respective operations to be described subsequently the operation for rotating the pair of massaging wheels in the downward massaging direction can be performed in the same manner as that at the step S141. Thus, in the case where the switch 227 is at the position of "STORE" and the massaging apparatus is not in the storing state, the program proceeds through the steps S137, S139 and S141, whereby the preparatory operation for the storing state is performed. At the time point when the pair of massaging wheels are at the upper end position Y1, the spacing between the pair of massaging wheels is the maximum spacing X3 and the protruding amount Z is minimal the program proceeds to the step S135, whereby all the loads are deenergized and the output terminal O9 of the microprocessor 263 is brought to the low level and the light emitting device 259 is turned off. When the massage apparatus is thus brought to the storing state, a user is prevented from strongly bumped to the massaging wheels even if he sits down on the chair in a rush manner.

Now description will be made of the case where the switch 227 is at the position of "OPERATION" and none of the switches 229 to 245 have been operated. In such a case the microprocessor 265 receives the data from the microprocessor 263 and the high level signal is obtained at the output terminals O12 and O14 until any one of the switches 229 to 245 is operated. Accordingly, the light emitting devices 279*a* and 281*a* and 287*a* are turned on. Therefore, the forward rotating circuit 301 included in the motor driving circuit 299 is rendered conductive, whereby the motor 51 is rotated in the forward direction. At the same time the transistor 311 included in the solenoid driving circuit 309 is rendered conductive, whereby the solenoid of the electromagnetic brake 57 is energized and the worm shaft 95 (FIG. 3) is braked. Thus, until any one of the switches 229 to 245 is operated, the worm shaft 97 and the main shaft 39 are driven for rotation at the position whereby the power supply switch 295 is turned on, whereby the pair of massaging wheels are rotated in the upward massaging direction (the step S127). Meanwhile, it is in advance pointed out that, at the respective operations to be described subsequently, the operation for driving the pair of massaging wheels in the upward massaging direction is performed in the same manner as that at the step S127.

Referring to FIG. 19, the operation in the case where the manual operation of the switch 229 is detected at the previous step S107 will be described. The switch 229 is operated for the purpose of "SPINE STRETCHING". When the operation of the switch 229 is detected at the previous step S107, the microprocessor 263 of the embodiment shown refers to the input terminals I6 to I9 at the step S201 for the purpose of performing the operation associated with the operation of the switches 239 to 245 in preference to the switches 229 to 237, thereby to determine whether any one of the switches 239 to 245 is an on-state. More specifically, the microprocessor 265 determines based on the data signal from the microprocessor 263 whether interruption is to be made from the switches 239 to 245. In the case where interruption is to be made, the program proceeds to the top step S1101 of the routine to be described subsequently with reference to FIG. 28. In the absence of interruption, at the following step S203 the microprocessor 265 determines whether the spacing X between the pair of massaging wheels is narrower than the intermediate spacing X2. This decision is made based on the signal of the input terminals I14 and I15 of the microprocessor 265. More specifically, as described previously, if and when only the photoelectric switch 203 is turned off, i.e. only the input terminal I15 is the high level, the microprocessor 265 determines as $X \leqq X2$. If decision is made as "YES" at the step S203 the microprocessor 265 refers to the input terminals I16 and I17 at the following step S205, thereby to determine whether the protruding amount Z of the pair of massaging wheels is the maximum. More specifically, as described previously, when the reed switch 209 is turned on, the protruding amount Z becomes the maximum. If and when decision is made as "NO" at the step S203, the microprocessor 265 provides the high level signals at the output terminals O12, O14 and O16. Accordingly, the forward rotating circuit 301 included in the motor driving circuit 299 is rendered conductive, whereby the motor 51 is rotated in the forward direction. At the same time both of the transistors 311 and 315 included in the solenoid driving circuit 309 are rendered conductive, whereby the solenoid of the electromagnetic brake 57 and the solenoidd of the electromagnetic clutch 61 are energized. Accordingly, the feed shaft 47 (FIG. 3) is rotated and the spacing between the pair of massaging wheels is decreased. It is in advance out that the operation "NARROW" for decreasing the spacing between the pair of massaging wheels in the respective operations to be described subsequently can be made in the same manner as that at the step S207. If and when decision is made as "NO" at the previous step S205, the microprocessor 265 functions at the step S209 to maximize the protruding amount Z by rotating the pair of massaging wheels in the upward massaging direction in the same manner as that at the step S127 in FIG. 18. When the switch 229 for stretching the spine is thus turned on, adaptation is made such that the spacing $X \leqq X2$ and $Z=$maximum. Thus the preparatory operation for stretching the spine is completed. Meanwhile, the pulse signal is obtained from the microprocessor 263 at the output terminal O9 during the preparatory operation period. Accordingly, the light emitting device 259 is turned on in a blinking manner, whereby the user is notified that the preparatory operation is being made.

The preparatory operation for stretching the spine is thus completed. Meanwhile, by "SPINE STRETCHING" is meant a massage mode in which the pair of massaging wheels are moved upward and downward without the inner wheels fixed to the main shaft of the pair of massaging wheels being rotated while the outer wheels 75 (FIG. 4) of the massaging wheels 45 may be rolled along the spine of a human body placed on the back rest of the chair. When the preparatory operation is thus completed as described above, the output terminal O9 of the microprocessor 263 is brought to the low level and the light emitting device 259 is turned off, while the microprocessor 264 moves upward and downward the massaging wheels without the same being rotated. At the step S211 the microprocessor 265 determines whether $Y=Y1$ as done at the previous step S129 and if the decision is made as "NO" then at the following step S213 the pair of massaging wheels are moved upward as done at the previous step S137. On the other hand, if and when the decision is made at the step S211 as "YES" then the microprocessor 265 moves the pair of massaging wheels at the following steps S215. More specifically, the microprocessor 265 provides the high level signals at the output terminals O12 and O15. Accordingly, the light emitting devices 279*a* and 281*a* and 289*a* are turned on. Accordingly, the forward rotating circuit 301 included in the motor driving circuit 299 is rendered conductive, whereby the motor 51 is rotated in the forward direction and at the same time the transistor 313 included in the solenoid driving circuit 309 is rendered conductive and the solenoid of the electromagnetic brake 59 is energized. Therefore, the shifting shaft 69 (FIG. 4) is rotated and the pair of massaging wheels 45 are moved downward. Meanwhile, it is in advance pointed out that in the respective operations to be described subsequently the operation "LOWER" for moving downward the pair of massaging wheels is carried out in the same manner as that at the step S215. At the following step S217 the microprocessor 265 refers to the signals at the input terminals I12 and I13 to determine whether Y=Y3. More specifically, it is determined whether the photoelectric switch 287 (FIG. 7) is turned off. If and when decision is made at the step S217 as "YES", the program returns to the previous step S213. Thus, in the spine stretching operation the pair of massaging wheels are moved upward and downward between the upper end position Y1 and the lower end position Y3 without the same being driven for rotation. Assuming that the switch 241 or 239 is operated at the step S219 or S221 in the course of the upward and downward movement of the pair of massaging wheels, an operation in accord with such operation of the switch is performed. More specifically, if decision is made at the step S219 as "YES" this means that the downward movement is commanded during the upward movement period of the pair of massaging wheels and accordingly the microprocessor 265 proceeds to the step S215. If decision is made at the step S221 as "YES", this means that upward movement is commanded in the course of the downward movement of the pair of the massaging wheels and the microprocessor 265 proceeds to the step S213. If and when decision is made as "NO" at the step S219, the program returns to the previous step S101. If and when decision is made as "NO" at the step S221, the program returns to the previous step S215. It could happen that jump is made to the step S203 from the step S711, S813, S913, S923, S1011 or S1115 to be described subsequently.

Now referring to FIG. 20, an operation in the case where the switch 231 is operated will be described. The switch 231 is manually operated for the purpose of performing "NECK MASSAGE". When it is detected at the previous step S109 that the switch 231 is turned on, then the microprocessor 263 determines whether interrupt is available from the switches 239 to 245 as done at the previous step S201. If interrupt is available, then the program proceeds to the step S1101 to be described subsequently. In the absence of the interrupt from these switches 239 to 245, the microprocessor 265 brings the pair of massaging wheels to the upper end position Y1, whereupon the spacing between the pair of massaging wheels is decreased to the minimum spacing X1 and then the pair of massaging wheels are driven for rotation in the upward massaging direction. More specifically, the microprocessor 265 determines at the step S303 whether Y=Y1 in the same manner as that at the previous step S129 and in the case where decision is made as "NO" the pair of massaging wheels are moved upward up to the upper most position Y1 in the same manner as that at the previous step S137. On the other hand, decision is made at the step S303 as "YES", then the microprocessor 265 determines at the following step S307 whether X≦X1. More specifically, the microprocessor 265 refers to the signals at the input terminals I14 and I15 to detect the state of the photoelectric switches 201 and 203. If and when the phototransistor 201*b* is turned off and the phototransistor 203*b* is turned on, i.e. the input terminal I14 is the low level and the input terminal I15 is the high level, then the microprocessor 265 determines that X≦X1. If and when decision is made at the step S307 as "NO", then the microprocessor 265 functions to decrease the spacing between the pair of massaging wheels to the minimum spacing X1 as in the same manner as that at the previous step S207. On the other hand, if decision is made at the step S307 as "YES", then the microprocessor 265 drives the pair of massaging wheels for rotation in the upward massaging direction in the same manner as that at the previous step S127. Meanwhile, the operation is in the preparatory operation period until the step S311 is reached and the microprocessor 263 provides the pulse signal at the output terminal 09 and accordingly the light emitting device 259 is turned on in a blinking manner. When the switch 231 for "NECK MASSAGE" is thus turned on, not only the pair of the massaging wheels are brought to a predetermined position and a predetermined spacing but also the rotation direction of the same is also brought in the upward massaging direction suited for neck massaging. Meanwhile, jump could be made to the step S311 also from the step S711, S813, S913, S923, S1011 or S1115 to be described subsequent.

Now referring to FIG. 21, the operation in the case where the switch 233 is operated will be described. The switch 233 is manually operated for the purpose of performing "SHOULDER MASSAGE". When it is detected at the previous step S111 that the switch 233 is turned on, then the microprocessor 265 determines whether interrupt is available from any of the switches 239 to 245 which is to be preferentially processed, in the same manner as that at the previous step S201. If and when interrupt is available, the program proceeds to the step S1101. On the other hand, in the absence of the interrupt, the microprocessor 265 brings the pair of the massaging wheels to the upper end position Y1 and make the spacing between the pair of the massaging wheels be the intermediate spacing X2, while driving the pair of the massaging wheels for rotation in the downward massaging direction. More specifically, the microprocessor 265 detects at the step S403 whether Y=Y1 in the same manner as that at the previous step S129. If it is detected otherwise, the microprocessor 265 functions at the step S405 to move the pair of the massaging wheels upward in the same manner as that at the step S137. If and when decision is made at the step S403 as "YES", then at the following step S407 the microprocessor 265 determines whether X≦X2 in the same manner as that at the previous step S203. If decision is made as "NO", then at the following step the microprocessor 265 functions to decrease the spacing between the pair of the massaging wheels in the same manner as that at the previous step S207. Thus the preparatory operation is completed. During the preparatory operation period the light emitting device 259 is turned on in a blinking manner, whereby the user is notified that the preparatory operation is going on. When the preparatory operation is completed, the microprocessor 265 functions at the following step S411 to drive for rotation the pair of the massaging wheels in the downward massaging direction in the same manner as that at the previous step S141. Meanwhile, jump could be made to the step S411 from the step S711, S813, S913, S923, S1011 or S1115 to be described subsequently. When the switch 233 for "SHOULDER MASSAGE" is thus turned on, not only the pair of the massaging wheels are brought to a predetermined position and a predetermined spacing but also the rotation direction of the pair of the massaging wheels is brought to be in the downward massaging direction which is effective for shoulder massaging.

Now referring to FIG. 22, an operation in the case where the switch 235 for "BACK MASSAGE" is operated will be described. When it is detected at the previous step S113 that the switch 235 is turned on, the microprocessor 265 detects at the step S501 whether the interrupt from any of the switches 239 to 245 is available. In the presence of the interrupt, then the program proceeds to the step S1101. On the other hand, in the absence of the interrupt, the microprocessor 265 determines at the following step S503 whether $Y>Y2$. More specifically, the microprocessor 265 refers to the signal from the input terminals I12 and I13 to detect the state of the photoelectric switches 185 and 187. If and when the phototransistor 185*b* is turned on, i.e. the input terminal I12 is the high level, the microprocessor 265 detects whether $Y>Y2$. The step S503 is interposed to eliminate any possible danger of forcibly oppressing from upward the shoulders with the massaging wheels in the case where the pair of the massaging wheels are moved downward with an increased protruding amount Z of the massaging wheels. More specifically, if decision is made at the step S503 as "YES", first the protruding amount Z of the massaging wheels is minimized. To that end, if decision is made at the step S503 as "YES", the microprocessor 265 functions at the following step S505 to refer to the signals at the input terminals I16 and I17 to drive for rotation the pair of the massaging wheels in the upward massaging direction until the reed switch 211 is turned on, i.e. the input terminal I17 becomes the high level, thereby to minimize the protruding amount Z of the pair of the massaging wheels. Therefore, at the step S505 the microprocessor 265 provides the high level signal at each of the output terminals 012 and 014 in the same manner as that at the previous step S127. Meanwhile, it is in advance pointed out that the operation "SET Z=MIN." for the protruding amount setting in the respective operations to be described subsequently can be made in the same manner as that at the step S505. If and when the protruding amount Z is set at the step S505 to the minimum to eliminate an undesired oppression to a human body, then at the following step S507 the microprocessor 265 functions to move downward the pair of the massaging wheels in the same manner as that at the previous step S215. At that time the microprocessor 263 detects at the step S509 whether the interrupt from the switches 239 to 245 is available. Thereafter the microprocessor 265 again determines at the step S511 whether $Y\geqq Y2$ in substantially the same manner as that at the previous step S503. More specifically, at the steps S507 and S511 the pair of the massaging wheels are moved downward until $Y=Y2$ is attained. If and when $Y>Y2$ at the previous step S503, as seen from FIGS. 13 and 14 it could happen that $X>X2$ has been attained. Accordingly, at the step S513 the microprocessor 265 determines whether $X>X2$. More specifically, the microprocessor 265 determines whether $X>X2$ when the input terminal I15 is the low level. If decision is made at the step S513 as "YES", then the microprocessor 265 functions to decrease the spacing between the pair of the massaging wheels in the same manner as that at the previous step S207. On the other hand, if decision is made at the step S513 as "NO", this means that the preparatory operation is completed and the microprocessor 265 functions at the step S517 to drive for rotation the pair of the massaging wheels in the upward massaging direction in the same manner as that at the previous step S127. On the other hand, if decision is made at the previous step S503 as "NO", the microprocessor 265 functions to move upward the pair of the massaging wheels until $Y\geqq Y2$ is attained through the steps S519 and S523. Meanwhile, at the step S521 the microprocessor 265 determines whether the interrupt is available from the switches 239 to 245 based on the data signal from the microprocessor 263. If and when interrupt is available at the steps S501, S509 and S521, the program proceeds to the step S1101. If decision is made at the step S523 as "YES", this means that the preparatory operation is completed and the microprocessor 265 functions at the step S525 to drive for rotation the pair of the massaging wheels in the upward massaging direction. Meanwhile, the light emitting device 259 is turned on in a blinking manner during the preparatory operation period and the same is turned off during the operation as in the case of any other operations. Jump could be made to the step S517 or S525 from the step S711, S813, S913, S923, S1011 or S1115 to be described subsequently. When the switch 235 for "BACK MASSAGE" is thus turned on, the pair of the massaging wheels is brought to the approximate intermediate position Y2 and the spacing of the pair of the massaging wheels is made to be the intermediate spacing X2, whereupon the pair of the massaging wheels is driven for rotation in the upward massaging direction.

Figure 13:
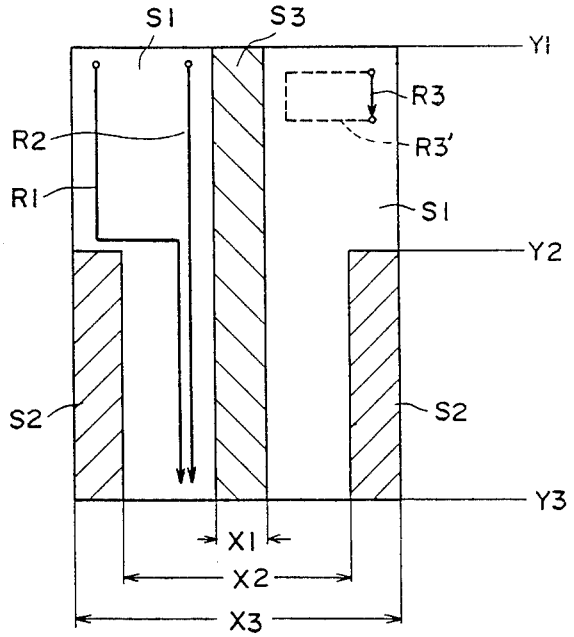
FIGS. 13 and 14 are diagrammatic views showing an allowed region and a forbidden region.
Figure 14:
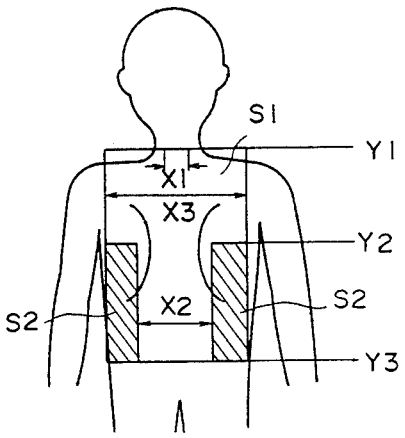

Meanwhile, if decision is made at the previous step S503 as "NO", no control was made to decrease the spacing between the pair of the massaging wheels. The reason is that the hatched portion in FIGS. 13 and 14 is deemed as a forbidden region so that no possibility is prevented from becoming $X>X2$ if and when $Y<Y2$.

More specifically, in the embodiment shown the forbidden regions S2 and S3 have been set within the range where the pair of the massaging wheels can inherently move. In other words, with the embodiment shown the region where the pair of the massaging wheels can actually move freely is restricted only within the allowed region S1. The forbidden region S2 is the region shown as hatched in FIGS. 13 and 14, which is defined by the intermediate position Y2 and the lower end position Y3 and the intermediate spacing X2 and the maximum spacing X3. If and when the pair of the massaging wheels are to be moved to perform a massaging operation in the above described region, then there could be a fear that the waist of a human body is oppressed or the chest of the human body is oppressed. For the purpose of eliminating such fear and in order to enable a massaging operation in a wider region with respect to a shoulder portion of the human body, therefore, the allowed region S1 and the forbidden region S2 are set as shown in FIGS. 13 and 14. Meanwhile, since the range narrower than the minimum spacing as shown in FIG. 13 is set as the forbidden region S3 in view of the fact that the pair of the massaging wheels 45 are provided obliquely to the main shaft as shown in FIG. 4 and for the purpose of preventing force from being directly exerted to the spine of a human body. Meanwhile, the allowed region S1 thus set is selected to be in the range enough to cover the best points for massage which are well-known to exist throughout the back of the human body. As described with reference to FIG. 1, the shape of the cushions 19 provided on the back rest 7 of the chair has been also selected such that the width thereof is increased downward for the purpose of adaptation to the above described forbidden region S2. Therefore, comfortableness in sitting on the chair is enhanced by the cushions 19 (FIG. 1) and undesired force is prevented from being exerted to the human body, while the massaging wheels can be moved on the required portions.

Now referring to FIG. 23, an operation in the case where the switch 237 for "WAIST MASSAGE" will be described. When the operation of the switch 237 is detected at the previous step S115, it is then determined at the step S601 whether interrupt is available from any of the switches 239 to 245 in the same manner as that at the previous step S201. In the presence of the interrupt, the program proceeds to the step S1101 to be described subsequently. In the absence of the interrupt, at the following step S603 the microprocessor 265 determines whether $Y>Y2$ in the same manner as that at the previous step S503. If decision is made at the step S603 as "YES", at the step S605 the protruding amount Z of the pair of the massaging wheels is set to the minimum in the same manner as that at the previous step S505 and at the step S607 the pair of the massaging wheels are moved downward in the same manner as that at the previous step S215. If decision is made at the step S603 as "NO", the microprocessor 265 determines at the following step S609 whether $X \geqq X2$ in the same manner as that at the previous step S513. If decision is made at the step S609 as "YES", the microprocessor 265 functions at the following step S611 to decrease the spacing X between the pair of the massaging wheels in the same manner as that at the previous step S207. If decision is made at the step S609 as "NO", the microprocessor 265 determines at the step S613 whether $Y=Y3$. More specifically, the microprocessor 265 refers to the signals at the input terminals I12 and I13 to detect whether the photoelectric switches 185 and 187 (FIG. 7) are turned on or off. If and when the phototransistor **185*b* is turned off and the phototransistor 187*b* is turned on, i.e. the input terminal I12 is the low level and the input terminal I13 is the high level, the microprocessor 265 determines that $Y=Y3$. If decision is made at the step S613 as "NO", the microprocessor 265 functions at the step S615 to minimize the protruding amount Z of the pair of the massaging wheels and functions at the step S617 to move downward the pair of the massaging wheels. The fact that decision is made at the step S613 as "YES" means that the preparatory operation for "WAIST MASSAGE" is completed. The light emitting device 259 is lighted in a blinking manner during the preparatory operation, as described previously. When the preparatory operation is completed, the light emitting device 259 is turned off and at the same time the microprocessor 265 functions at the following step S619 to drive for rotation the pair of the massaging wheels in the upward massaging direction in the same manner as that at the previous step S125. When the switch 237** for "WAIST MASSAGE" is thus turned on, adaptation is made as $Y=Y3$ and $X=X2$ and the pair of the massaging wheels are driven for rotation in the upward massaging direction.

From the foregoing description it would be appreciated that only manual operation of any of the switches 229 to 237 for designating a massage mode achieves automatic setting of the position Y and the spacing X and the rotation direction of the massaging wheels associated with the massage mode as designated. Accordingly, a user can be free from complicated manual operation conventionally required. Although no description was made in conjunction with FIGS. 19 to 23, when any one of the switches 229 to 237 is manually operated, the high level signal is obtained from any corresponding one of the output terminals 04 to 08 of the microprocessor 263, whereby any one of the light emitting devices 249 to 257 is driven to be lighted. As a result, the user can readily know the massage mode presently selected.

Although designation of a given massage mode by the switches 229 to 237 as described above automatically sets the position and spacing of the massaging wheels, if and when such automatic setting determines a position which is slightly of the position where the user desires massaging, adjustment is made to the optimum position and spacing of the massaging wheels through manual operation. The switches 239 to 245 are provided for that purpose.

Referring to FIG. 24, an operation in the case where the switch 239 is operated will be described. If and when it is detected that the switch 239 is turned on at the previous step S117 or S201, S301, S401, S501, S509 or S601, the microprocessor 263 first determines whether the switch 227 is in the "OPERATION" position in the same manner as that at the previous step S105. If decision is made at the step S701 as "NO", the program returns to the previous step S101. If decision is made at the step S701 as "YES", then at the following step S703 the microprocessor 265 determines whether $Y=Y1$ in the same manner as that at the previous step 129. If decision is made at the step S705 as "YES", the pair of the massaging wheels cannot be moved upward any more in spite of the fact that the switch 239 has been turned on for the purpose of moving upward the pair of the massaging wheels and therefore at the step S705 all the loads are deenergized in the same manner as that at the previous step S125. If decision is made at the step S703 as "NO", i.e. unless the pair of the massaging wheels has reached the upper end position Y1, the microprocessor 265 is responsive to the switch 239 being turned on to move upward the pair of the massaging wheels in the same manner as that at the previous step S137. Thereafter again at the steps S709 and S711 the switches 227 and 239 are confirmed. If decision is made at the step S711 as "NO", i.e. the switch 239 is turned off, jump is made to the previous step S203, S311, S411, S517 S525 or S619. Thus, the upward and downward directional position Y of the massaging wheels can be arbitrarily controlled in a manual manner by the switch 239.

Now referring to FIG. 25, an operation in the case where the switch 241 is operated will be described. When it is detected at the previous step S119 or S201, S301, S401, S501, S509 or S601 that the switch 241 is turned on, then it is confirmed at the step S801 whether the switch 227 of the operating unit 27 is at the "OPERATION" position. Then at the following step S803 the microprocessor 265 determines whether $Y=Y3$, i.e. the pair of the massaging wheels can be further moved downward in the same manner as that at the previous step S615. If decision is made at the step S803 as "YES", the microprocessor 265 functions at the step S805 to deenergize all the loads in the same manner as that at the previous step S125. If decision is made at the step S803 as "NO", the microprocessor 265 determines at the following step S807 whether $Y>Y2$ in the same manner as that at the previous step S503. If decision is made at the step S807 as "NO", then the spacing between the pair of the massaging wheels must be naturally shorter than the intermediate spacing X2, as described previously, and accordingly the microprocessor 265 functions at the following step S809 to move downward the pair of the moving wheels in the same manner as that at the previous step S507. The microprocessor 265 confirms the switches 227 and 241 at the following steps S811 and S813.

If decision is made at the previous step S807 as "YES", the microprocessor 265 then determines at the step S815 whether X>X2 in the same manner as that at the previous step S513. More specifically, at the step S815 it is determined which one of the route R1 or R2 shown in FIG. 13 is to be taken in moving downward the pair of the massaging wheels. More specifically, in the case where the position Y of the pair of the massaging wheels is above the intermediate position Y2, when the spacing between the pair of the massaging wheels is larger than the intermediate spacing X2, the pair of the massaging wheels as they stand cannot be moved downward, as seen from FIG. 13. Conversely, in the case of X≦X2 even in the case of Y>Y2, the pair of the massaging wheels as they stand can be moved downward. Accordingly, if decision is made at the step S815 as "YES", the microprocessor 265 functions at the following step S817 to decrease the spacing between the pair of the massaging wheels in the same manner as that at the previous step S207. If decision is made at the step S815 as "NO", the microprocessor 265 determines whether Y=Y3 in the same manner as that at the previous step S803. If decision is made at the step S819 as "NO", the pair of the massaging wheels are moved downward in the same manner as that at the previous step S809. If decision is made at the step S819 as "YES", then at the step S805 all the loads are deenergized. After the steps S817 and S821, the program returns to the previous step S811 as in the case after the step S805, thereby to confirm the position of the switch 227. If decision is made at the following step S813 as "NO", jump is made to the step S203, S311, S411, S517, S525 or S619 in the same manner as that at the previous step S711.

In the case where the pair of the massaging wheels are thus moved downward, the same are moved downward along any of the two routes R1 and R2 (FIG. 13) depending on the upward/downward directional position Y. In the case where the downward moving operation and the spacing decreasing operation are required as shown as the route R1, first the downward movement is made to become Y=Y2 and then the spacing is controlled. The reason why such movement is adapted to be made is that whereas inherently the route R3 may be followed, in a certain case it could happen that a redundant route R3′ shown by the dotted line is followed. In the light of the function of the planetary device 55 (FIG. 3), i.e. in the light of the fact that the change of the upward/downward directional position Y of the pair of the massaging wheels and the change of the spacing X between the pair of the massaging wheels cannot be made simultaneously, it is better to change the upward/downward directional position first and then to change the spacing in order to move the massaging wheels in the shortest distance. The reason is that assuming that the spacing between the pair of the massaging wheels is first to be decreased such change of the spacing could be wasteful in the case where the upward/downward directional position need not be moved below the intermediate position Y2. More specifically, as is understood from FIG. 13, if the position of the pair of the massaging wheels is above the intermediate position Y2, always the pair of the massaging wheels can be freely moved and it is only when the position of the pair of the massaging wheels are moved downward to exceed the intermediate position Y2 that the spacing between the pair of the massaging wheels is restricted.

Now referring to FIG. 26, an operation in the case where the switch 243 is operated will be described. If it is detected at the previous step S121 or S201, S301, S401, S501, S509 or S601 that the swiitch 243 is turned on, then first at the step S901 it is confirmed whether the position of the switch 227 is in "OPERATION". At the following step S903 the microprocessor 265 determines whether Y>Y2 in the same manner as that at the previous step S503. The reason why the step S903 is provided is that, as seen from FIG. 13, the maximum limit of the spacing changeable depending on the position of the upward/downward directional position Y of the pair of the massaging wheels is different such as up to X3 or up to X2. Accordingly, if the decision is made at the step S903 as "YES", the microprocessor 265 determines at the following step S905 whether X>X3 in the same manner as that at the previous step S131. If decision is made at the step S905 as "YES", this means that the spacing between the pair of the massaging wheels cannot be increased any more and accordingly the microprocessor 265 functions at the following step S907 to deenergize all the loads in the same manner as that at the previous step S125. If decision is made at the step S905 as "NO", the microprocessor 265 functions at the following step S909 to increase the spacing between the pair of the massaging wheels in the same manner as that at the previous step S139. At the following steps S911 and S913 the state of the switches 227 and 243 is confirmed.

On the other hand, if decision is made at the previous step S903 as "NO", the microprocessor 265 determines at the following step S915 whether X>X2 in the same manner as that at the previous step S513. If X>X2 and not Y>Y2, the spacing between the pair of the massaging wheels cannot be increased any more even if the switch 241 is turned on and therefore, if decision is made at the step S915 as "YES", the microprocessor 265 functions at the following step S917 to deenergize all the loads in the same manner as that at the previous step S907. If decision is made at the step S915 as "NO", the microprocessor 265 functions at the following step S919 to increase the spacing between the pair of the massaging wheels in the same manner as that at the previous step S909. Then at the following steps S921 and S923 the state of the switches 227 and 243 is confirmed. If decision is made at the steps S913 and S923 as "NO", jump is made to the step S203, S311, S411, S517, S525 or S619. If the switch 243 has been thus turned on, the spacing X between the pair of the massaging wheels can be manually changed and increased.

Now referring to FIG. 27, an operation in the case where the switch 245 is operated will be described. If it is detected at the previous step S123 or S201, S301, S401, S501, S509 or S601 that the switch 245 is turned on, at the first step S1001 it is confirmed whether the position of the switch 227 is in "OPERATION". Then at the following step S1003 the microprocessor 265 determines whether X=X1 in the same manner as that at the previous step S307. The reason is that as shown in FIG. 13 the region defined in the minimum spacing X1 has been set as the forbidden region S3. Accordingly, if decision is made at the step S1003 as "YES", the microprocessor 265 functions at the followings step S1005 to deenergize all the loads in the same manner as that at the previus step S125. If decision is made at the step S1003 as "NO", the microprocessor 265 functions to decrease the spacing between the pair of the massaging wheels in the same manner as that at the previous step S207. Thereafter at the steps S1009 and S1011 the state of the switches 227 and 245 is confirmed. If decision is made at the step S1011 as "NO", jump is made to the step S203, S311, S411, S517, S525 or S619.

Finally, referring to FIG. 28, an operation in the case where interrupt is available from any one of the switches 239 to 245 will be described. If it is detected at the previous step S201, S301, S401, S501, S509 or S601 that interrupt is detected, the microprocessor 265 determines at the steps S1101 to S1107 whether any one of the switches 239 to 245 is turned on based on the signal obtained from the microprocessor 263. When the switch 239 is turned on, jump is made to the previous step S701. Likewise, when the switch 241, 243 or 245 is turned on, jump is made to the step S801, S901 or S1001. If decision is made at any of the previous steps S1101 to S1107 as "NO", the microprocessor 263 determines at the step S1109 whether double key entry was made. If decision is made at the step S1109 as "NO", then the program returns to the first step S101, whereas if decision is made at the step S1109 as "YES" the position of the switch 227 is confirmed at the step S1111. If the position of the switch 227 is in "OPERATION", the microprocessor 265 functions at the following step S1113 to deenergize all the loads in the same manner as that at the previous step S125. Then at the step S1115 it is confirmed whether the double key entry was made. If decision is made at the step S1115 as "YES", then the program returns to the previous step S1111, whereas if decision is made at the step S1115 as "NO" jump is made to the previous step S203, S311, S411, S517, S525 or S621. When the switch 229 or 237 for designating the massage mode is turned on and the switches 239 and 241 or 243 and 245 for manually changing the position Y or manually changing the spacing X are turned on, the same is detected by the microprocessor 263 and interrupt is applied to the microprocessor 265. Then at the position as moved by the switches 239 to 245 massaging of the desired manner is again started. Accordingly, it is possible to achieve the desired massage at any desired position and in any desired spacing.

Meanwhile, if and when these switches 239 to 245 are operated while the position and/or the spacing are being automatically changed responsive to operation of the switches 229 to 237, i.e. during the preparatory operation period when the light emitting device 259 is turned on in a blinking manner, the microprocessor 265 is responsive to the interrupt from the microprocessor 263 to cancel the output for control responsive to the switches 229 to 239. Then the microprocessor 265 makes a control such that the massage is started in the massage mode designated by the switches 229 to 237 at the position and/or with the spacing attained at the time when the interrupt was applied. Accordingly, if the massage is sought during a time period of change of the position and/or the spacing during the preparatory operation period, then the operation immediately enters into the massage operation. Accordingly, convenience of operation is excellent.

According to the embodiment shown, the pair of the massaging wheels are driven for rotation in the downward massaging direction when the switch 233 is selected and the same are driven for rotation in the upward massaging direction when the other switch 231, 235 or 237 is selected. Since any particular switch for designating the rotation direction of the pair of the massaging wheels is not necessary, any complicacy of operation due to an increased number of switches can be evaded. Accordingly, in the case where a massaging operation is to be performed without designating the massage mode, i.e. without operating any of the switches 229 to 237, the microprocessor 265 notifies the microprocessor 263 of the same through the signal line 269. Accordingly, the microprocessor 263 provides at the output terminal 09 the output for causing the light emittting device 259 to make a blinking display such as in the preparatory operation period but to make a continuous display. Therefore, the user is urged to operate any one of the switches 231 to 237 through a look at the continuous display of the light emitting device 259. The reason is that in the case where massage is to be applied to the shoulder portions, for example, the pair of the massaging wheels have been driven for rotation in the upward massaging direction, as at the previous step S127, in spite of the fact that it is better to drive for rotation the pair of the massaging wheels in the downward massaging direction, as described previously. Meanwhile, display for urging operation of such switches 231 to 237 may be made using a separate light emitting device or may be of an audible alarm such as a buzzer. Even in the case where the light emitting device 259 is shared for that purpose, the same may be changed to make display in a blinking manner at a different speed in place of a continuous display.

As shown in FIG. 16, the microprocessor 265 receives the time base signal from the time base signal circuit 327. The time base signal is obtained at each cycle of the alternating current, for example. The microprocessor 265 further comprises a timer circuit in a given storing region of the random access memory, not shown. Such timer circuit, not shown, is triggered responsive to the switch 227 being in the "OPERATION" position or the power supply switch 265 being turned on when the switch 227 is in the "OPERATION" position, thereby to measure a predetermined time period say approximately fifteen minutes. The microprocessor 265 is responsive to the time-up signal from such timer circuit, not shown, to perform the same control as that when decision is made at the previous step S103 (FIG. 18) as "YES". More specifically, the microprocessor 265 is responsive to the time-up signal from the timer circuit to perform the control at the previous steps S129 to S141. The purpose is to evade any adverse influence due to overdue massage in the case where the user falls asleep. Meanwhile, the above described time circuit is reset responsive to operation of any one of the switches 227 to 245. Accordingly, if the user desires continual massage for more than fifteen minutes, then he must operate any one of these switches 227 to 245.

According to the embodiment shown, if the data signal such as necessitating the rotation of the motor 51 is sent from the microprocessor 263 to the microprocessor 265 as in the case where any one of the switches 227 to 245 is operated, for example, the microprocessor 265 provides the high level signal at the output terminal 012 or 013 with a delay of the time period t1 from the time point of operation of such switch, i.e. the time point of receipt of such data signal. Accordingly, the rotation of the motor 51 is delayed by that time period t1. If and when the data signal such as necessitating energization of the electromagnetic brake 57 or 59 or the electromagnetic clutch 61 obtainable such as in the case where any one of the switches 227 to 245 is operated, for example, is sent from the microprocessor 263 to the microprocessor 265, then the microprocessor 265 provides the high level signal at the output terminal 014, 015 or 016 with a delay by the time period t2. When one of the electromagnetic brakes 57 and 59 is brought from an enabled state to a disabled state and the other thereof is brought from a disabled state to an enabled state, then the microprocessor 265 brings both of them to a disabled state for a given minor time period t3. The purpose is to prevent the motor 51 from being overly loaded due to a simultaneous enabled state of the solenoids of two electromagnetic brakes 57 and 59. It is pointed out that in the foregoing the relation must be $t3<t1<t2$.

If and when change is being made of the position and/or the spacing of the pair of the massaging wheels responsive to the operation of the manual switches 239 to 245, as at the steps S705, S805, S907, S917 and S1005 described previously in conjunction with FIGS. 24 to 27, and in the case where the on-state of these switches 239 to 245 is still continued even after the limit is reached, then all the loads are deenergized. In the case where all the loads are to be thus deeneergized, the solenoid of the electromagnetic brake 57 is energized for a very short time period t4 for energization thereof is continued. The reason is that since the power transmitting mechanism employs the planetary device 55 (FIG. 3) a no-load state of the motor 51 makes astable operation of the planetary device to exceed the limit due to inertia rotation of the motor 51, whereby the position Y and/or the spacing X is still changed, with the result that the limit of the structure could be exceeded. Accordingly, in the case where all the loads are to be thus deenergized, it is intended to absorb the inertia rotation of the motor 51 by transmitting the same to the pair of the massaging wheels, by connecting the main shaft 39 serving as a load of no fear of such overrun to the motor 51 by the very short time period t4. The above described time period t4 may be very short and, for example, shorter than say one second and therefore power consumption is very minor but enough to fully prevent such overrun.

Even in the case where the motor 51 is to be made no-load, only the electromagnetic brake 57 is energized for a short time period, whereby the inertia of the motor is absorbed in the same manner as described in the foregoing.

Figure 7:
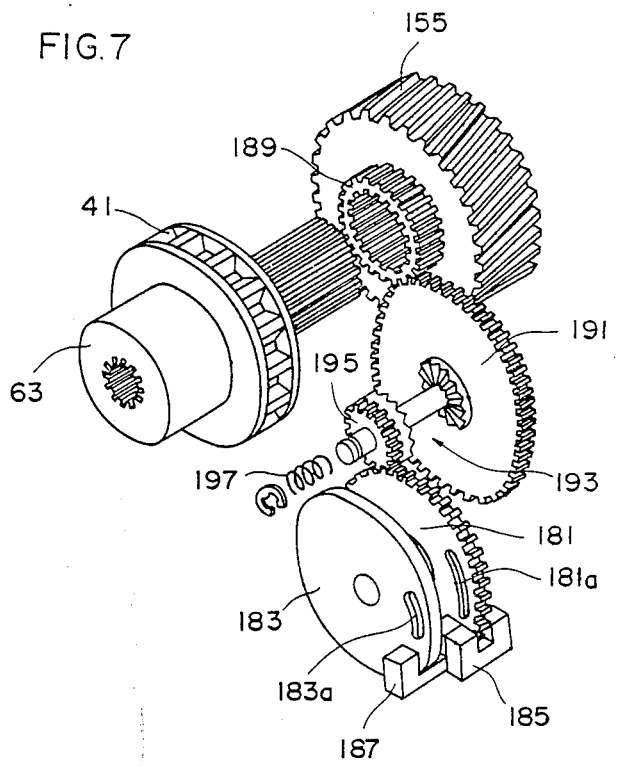
FIGS. 7, 8A, 8B and 9 illustrate an example of a mechanism for detecting the position Y of a pair of massaging wheels.
Figure 10:
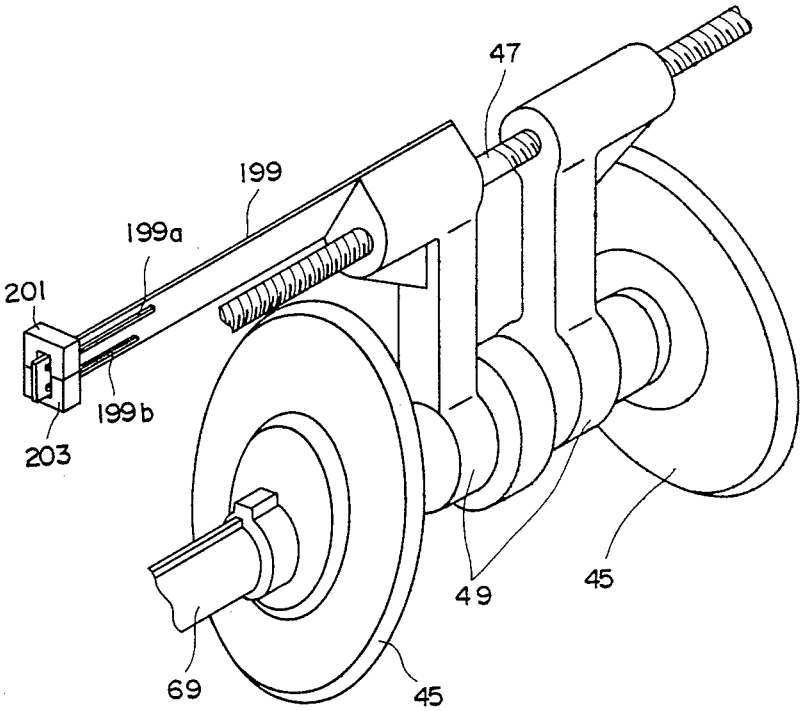
FIGS. 10, 11A and 11B illustrate an example of a mechanism for detecting the spacing X of a pair of massaging wheels.
Figure 11A:
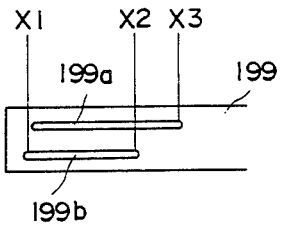
Figure 11B:
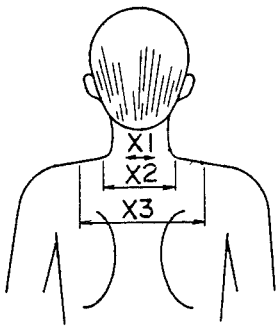

The above described flow diagrams are depicted in conjunction with the embodiment in which the position detecting circuit and the spacing detecting circuit employ the photoelectric switches as shown in FIGS. 7 and 10. However, it is to be understood that the present invention can be implemented with obvious changes or modifications of the above described flow diagrams even in the case where the detecting circuit employ such limit switches as shown in FIG. 12, for example.

The above described embodiment was also depicted as employing microprocessors. However, it is to be also understood that the present invention can be implemented using hardware circuits each performing the respective functions as per the flow diagrams of these microprocessors.

The above described embodiment was also depicted as employing a single motor to afford all driving force. However, separate motors may be utilized for the purpose of changing the position Y and for the purpose of changing the spacing X.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A massaging apparatus comprising:

a main shaft being capable of forward and reverse rotation, a pair of massaging wheels spaced a certain distance apart and attached to said main shaft, a position changing means for shifting said massaging wheels in a direction crossing the axis of said main shaft so as to change the position of the massaging wheels, a spacing changing means for moving said massaging wheels axially of said main shaft to change the spacing thereof, massage mode designating means for designating a mode of massage by said pair of massaging wheels, said message mode being determined by such elements as at least the position, spacing and direction of rotation of said massaging wheels, position detecting means for detecting the position of said massaging wheels, spacing detecting means for detecting the spacing of said massaging wheels, control means for controlling said position changing means and said spacing changing means in connection with said message mode designating means, said position detecting means and said spacing detecting means to adapt said massaging wheels to the selected massage mode, preparation completion detecting means for detecting the completion of preparatory operation when the position and spacing of said massaging wheels are adapted to a selected massage mode by said control means, rotary drive means for driving said main shaft for rotation, and rotative direction control means for controlling said rotary drive means in connection with said preparation completion detecting means to rotate said main shaft in a direction suited for a selected massage mode.

2. A massaging apparatus as set forth in claim 1, wherein said massaging wheels are obliquely attached to said main shaft.

3. A massaging apparauts as set forth in claim 1, wherein said pair of massaging wheels are obliquely and eccentrically attached to said main shaft, whereby an upward massage effect or downward massage effect is obtained depending upon the direction of rotation of said main shaft.

4. A massaging apparatus as set forth in claim 2 or 3, which further comprises protruding amount detecting means for detecting the protruding amount of the massaging wheels from said main shaft, and means for maximizing said protruding amount when the position of said massaging wheels is to be changed in connection with said massage mode designating means and said protruding amount detecting means.

5. A massaging apparatus as set forth in claim 4, which further comprises means for maximizing said protruding amount in connection with the designation of a massage mode by said massage mode designating means and with said protruding amount detecting means.

6. A massaging apparatus as set forth in claim 1, which further comprises notifying means for notifying that the apparatus is preparing for operation until completion of preparation is detected by said preparation detecting means in connection with said massage mode designating means.

7. A massaging apparatus as set forth in claim 1, which further comprises manual position control means for manually controlling the position of said massaging wheels by acting on said position changing means, and manual spacing control means for manually controlling the spacing of said massaging wheels by acting on said spacing changing means.

8. A massaging apparatus as set forth in claim 7, which further comprises manual priority means for giving higher priority to control to be effected by said manual position control means and said manual spacing control means than to control to be effected in response to a massage mode designated by said massage mode designating means.

9. A massaging apparatus as set forth in claim 1, wherein said control means controls said position changing means prior to said spacing changing means when a massage mode is designated which needs changes of both the position and the spacing of said massaging wheels.

10. A massaging apparatus as set forth in claim 1, which further comprises mode selecting means for conforming said massaging apparatus to at least an operation mode, and warning means for calling attention to designation to be made by said massage mode designating means in case where no massage mode is designated by said massage mode designating means after said operation mode has been established by said mode selecting means.

11. A massaging apparatus as set forth in claim 1, wherein the spacing of said massaging wheels is in a relatively narrow range defined in connection with a part of the range in which the position of said massaging wheels is variable, which further comprises spacing limiting means for limiting the spacing of said massaging wheels in connection with said position detecting means such that it is not more than a predetermined value.

12. A massaging apparatus as set forth in claim 11, which further comprises means for limiting the spacing of said massaging wheels such that it is not less than a predetermined value.

13. A massaging apparatus as set forth in claim 1, which further comprises an operating unit provided with said massage mode designating means, and a control circuit means provided in said operating unit and adapted to give said control means a data signal in the form of a pulse code relating to a massage mode designated in accordance with designation made by said massage mode designating means.

14. A massaging apparatus as set forth in claim 13, wherein said control circuit means gives said pulse code data signals a plurality of times to said control means, and wherein when at least two of said data signals coincide with each other, said control means controls said position changing means and said spacing changing means for the sake of a massage mode relating to said data signals.

15. A massaging apparatus as set forth in claim 13, wherein said massage mode designating means includes a plurality of manual switches corresponding to individual massage modes.

16. A massaging apparatus as set forth in claim 15, which further comprises a plurality of light emitting devices installed on said operating unit in connection with said manual switches, and means responsive to operation of any one of said manual switches for driving the corresponding light emittting device.

17. A massaging apparatus as set forth in claim 13, wherein said operating unit includes a position switch for manually changing the position of said massaging wheels and a spacing switch for manually changing the spacing of said massaging wheels, and said control circuit means gives said control means a data signal in the form of a pulse code in response to an operation on said position switch and spacing switch.

18. A massaging apparatus as set forth in claim 1, wherein said position changing means is adapted to be driven to move said massaging wheels and said spacing changing means is adapted to be driven to change the spacing of said massaging wheels, which further comprises a motor, and power transmitting means for transmitting the driving force of said motor switchingly to said position changing means or said spacing changing means.

19. A massaging apparatus as set fort in claim 18, wherein when a massage mode which needs to change both the position and the spacing of said massaging wheels is designated, said power transmitting means transmits the driving force of said motor first to said position changing means.

20. A massaging apparatus as set forth in claim 18, which further comprises means for transmitting the driving force of said motor to said main shaft, whereby said main shaft is driven by said motor.

21. A massaging apparatus as set forth in claim 20, wherein said control means includes means for causing forward rotation of said motor, and means for causing reverse rotation of said motor.

* * * * *